US007053741B2

(12) United States Patent
Tojo et al.

(10) Patent No.: US 7,053,741 B2
(45) Date of Patent: May 30, 2006

(54) ELECTROMAGNETIC ACTUATOR, MANUFACTURING METHOD THEREOF, AND FUEL INJECTION VALVE

(75) Inventors: Senta Tojo, Kariya (JP); Shinji Abo, Anjo (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 10/909,313

(22) Filed: Aug. 3, 2004

(65) Prior Publication Data

US 2005/0072950 A1 Apr. 7, 2005

(30) Foreign Application Priority Data

Sep. 17, 2003 (JP) ..... 2003-324819

(51) Int. Cl.
*H01F 7/08* (2006.01)

(52) U.S. Cl. ..... 335/220; 335/261

(58) Field of Classification Search ..... 335/220–234, 335/256, 261–262, 280–282; 251/129.1–19; 123/90.11; 428/692
See application file for complete search history.

(56) References Cited

U.S. PATENT DOCUMENTS 4,999,225 A * 3/1991 Rotolico et al. ..... 427/447
5,339,777 A * 8/1994 Cannon ..... 123/90.12
5,840,016 A * 11/1998 Kitano et al. ..... 600/159
6,331,270 B1 * 12/2001 Lefebvre et al. ..... 419/27
2002/0053966 A1 * 5/2002 Oyama et al. ..... 335/256
2002/0088505 A1 * 7/2002 Gay ..... 148/306
2004/0137247 A1 * 7/2004 Ono et al. ..... 428/473.5

FOREIGN PATENT DOCUMENTS

DE 10207133 A1 * 2/2002
JP 60-245206 * 5/1985
JP 09-32738 * 9/1997
JP 2001-65319 3/2001

* cited by examiner

*Primary Examiner*—Lincoln D. Donovan
(74) *Attorney, Agent, or Firm*—Nixon & Vanderhye PC

(57) ABSTRACT

A magnetism property of an armature is increased by including a moving core of sintered metal of 1LSS to 3LSS, and a shaft of a ferromagnetic material. By contrast, a stator core contains 0.005 to 0.1 weight % resin powder, whose particle diameter is set to 50 μm or less, in particular, 25 μm or less, so as to decrease a core loss and increase a magnetism property. The stator core thereby becomes approximately equivalent to the armature in a direct current magnetism property, so that an electromagnetic actuator and a fuel injection valve that are excel in suction force and response are provided.

19 Claims, 12 Drawing Sheets w0=0.005 WEIGHT %
w2=0.1 WEIGHT %

ELECTROMAGNETIC ACTUATOR, MANUFACTURING METHOD THEREOF, AND FUEL INJECTION VALVE

CROSS REFERENCE TO RELATED APPLICATIONS

This application is based on and incorporates herein by reference Japanese Patent Application No. 2003-324819 filed on Sep. 17, 2003.

FIELD OF THE INVENTION

The present invention relates to an electromagnetic actuator, a manufacturing method of an electromagnetic actuator, and a fuel injection valve, and, in particular, to a technology applying, to a stator core of an electromagnetic actuator, a composite magnetic material (hereinafter referred to "SMC" (Soft Magnetic Composite)) that is formed by solidifying iron powder and resin powder.

BACKGROUND OF THE INVENTION

As a conventional example, a fuel injection valve of a fuel injection device for vehicles will be explained. In recent years, reduction of $CO_2$ emission and purification of exhaust gases have been promoted in an automotive industry to improve environment.

In particular, a diesel engine has undergone fuel injection pressure increase, multiplication of fuel injection, etc. to the above problems. Therefore, an electromagnetic valve (valve using an electromagnetic actuator) is required to have a quick response property. To achieve the quick response property, it is proposed that a stator core affecting the response property uses SMC that is formed by solidifying iron powder and resin powder. (For example, refer to Patent Document 1)

[Patent Document 1] JP-2001-065319-A.

Meanwhile, in recent years, to increase a response speed, a study that aims at increasing a magnetism property of an armature has been developed. As a means for increasing the magnetism property of the armature, a technology (not known technology) where a shaft as well as a moving core is formed of a ferromagnetic material for enhancing a suction force to the stator core has been developed. Further, a technology where the magnetism property of the armature is increased by using silicon steel or the like as a magnetic material constituting the moving core has been developed.

Consequently, a stator core is required to be in response to an armature excelling in a magnetism property. It is known that, as the SMC decreases in the content ratio of a resin, the SMC increases in a magnetic flux density and in a static suction force. However, as the resin content is decreased, a core loss that affects a dynamic suction force is eventually increased. Therefore, when the SMC is used for the stator core and the resin content is thereby decreased, the magnetic flux density is increased but a response property is deteriorated due to increase of a core loss. Therefore, an electromagnetic actuator having a quick response cannot be provided.

SUMMARY OF THE INVENTION

The present invention is devised in consideration of the above problems. It is an object of the present invention to provide an electromagnetic actuator and fuel injection valve that excel in a suction force and in a response property by approximately equalizing an armature and stator core in their magnetism properties, for example, by controlling particle diameters of resin powder of a SMC constituting a stator core.

To achieve the above object, an electromagnetic actuator is provided with the following. An armature and a solenoid are provided. The armature is axially movably supported and includes a moving core having a magnetism property. The solenoid includes a coil that generates magnetomotive force due to conduction of electric current and a stator core that sucks the moving core by magnetomotive force generated by the coil. Here, the stator core is formed of a composite magnetic material formed by solidifying iron powder and resin powder, and direct current magnetism properties of the stator core and the moving core are approximately equivalent to each other.

In this structure, even when a moving core having an excellent magnetism property is developed, direct current magnetism properties of the stator core and moving core can be approximately equalized to each other, for instance, by controlling a magnetic flux density or core loss of the SMC constituting the stator core. Thus, magnetism properties of the stator core and moving core are sufficiently exerted together. This can provide an excellent electromagnetic actuator and fuel injection valve.

BRIEF DESCRIPTION OF THE DRAWINGS

The above and other objects, features, and advantages of the present invention will become more apparent from the following detailed description made with reference to the accompanying drawings. In the drawings.

DETAILED DESCRIPTION OF THE PREFERRED EMBODIMENTS

An electromagnetic actuator of an embodiment 1 includes an armature that is axially movably supported; and a solenoid. The armature has a moving core having a magnetism property. The solenoid has a coil that generates a magnetomotive force by conducting electric current, and a stator core that sucks the moving core by magnetic force generated by the coil. The stator core is a SMC (Soft Magnetic Composite or composite magnetic material) formed by solidifying iron powder and resin powder. Direct current magnetism properties of the stator core and moving core are approximately equivalent to each other.

A fuel injection valve of an embodiment 2 includes: a pressure control chamber that is fed with high-pressure fuel via an inlet orifice; a needle that is moved according to a fuel pressure of the pressure control chamber; and fuel injection hole that is opened and closed by the needle. Further, the stator core of the electromagnetic actuator is a SMC formed by solidifying iron powder and resin powder. Direct current magnetism properties of the stator core and moving core are approximately equivalent to each other.

EXAMPLE 1

An electromagnetic actuator of the present invention will be explained using an example 1, where the present invention is directed to a fuel injection valve (injector) that injects to feed fuel to each of cylinder of an internal combustion engine.

(Explanation of Fuel Injection Valve)

Figure 2:
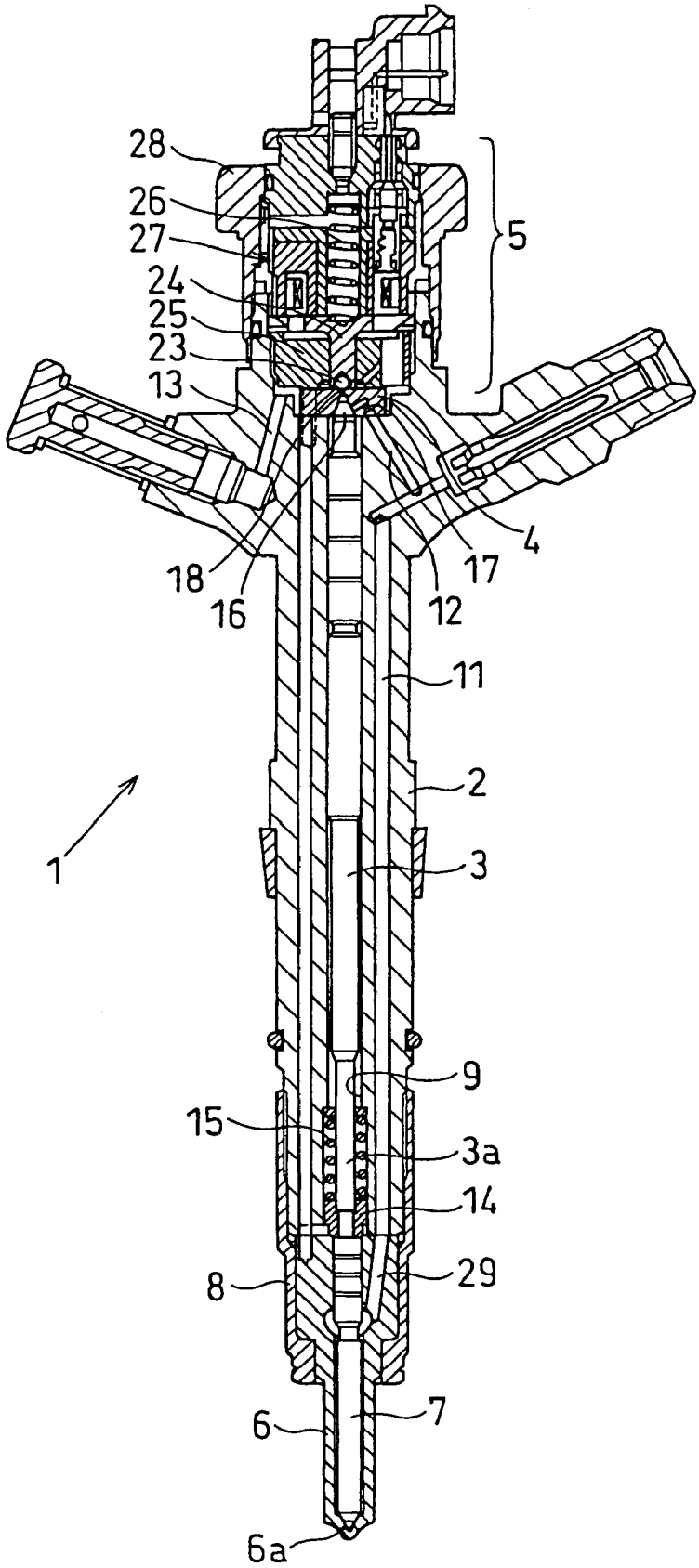
FIG. 2 is a sectional view of a fuel injection valve.

A fuel injection valve 1 shown in FIG. 2 is used, for example, in a pressure accumulation type fuel injection device, and injects to an engine combustion chamber high-pressure fuel fed from a common rail (not shown). This fuel injection valve 1 includes a nozzle (to be described later), a nozzle holder 2, a control piston 3, an orifice plate 4, an electromagnetic valve 5, etc.

The nozzle is constructed of a nozzle body 6 having an injection hole 6*a* in its tip, and a needle 7 that is inserted to be slidable within the nozzle body 6. The nozzle is fastened to a lower portion of the nozzle holder 2 using a retaining nut 8. The nozzle holder 2 contains: the cylinder 9 where the control piston is inserted; a fuel path 11 where the high-pressure fuel from the common rail is conducted towards the nozzle; a discharge path 13 where the high-pressure fuel from the common rail is conducted towards the orifice plate; and the like.

The control piston 3 is inserted to be slidable within the cylinder 9 of the nozzle holder 2, and is connected with the needle 7 via its tip of the control piston 3. A rod pressure 14 is disposed around a connection portion between the control piston 3 and the needle 7, and downward (direction for closing the valve) pushes the needle 7 by being biased by a spring 15 that is disposed upward of the rod pressure 14 and connected with the rod pressure 14.

Figure 1:
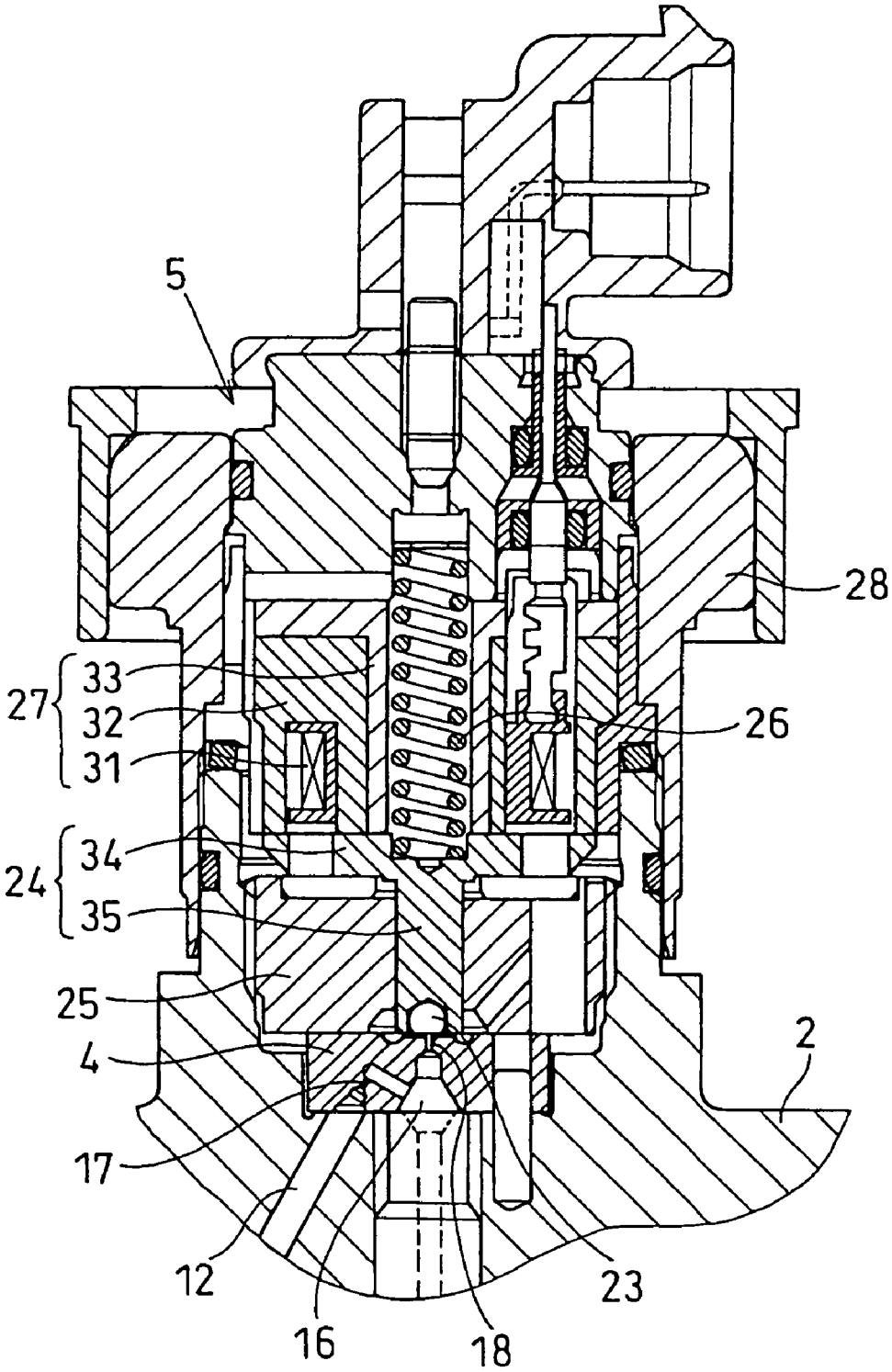
FIG. 1 is a sectional view of an electromagnetic valve mounted in a fuel injection valve.

The orifice plate 4 is disposed on the edge surface of the nozzle holder 2 where the cylinder 9 upward opens, and forms the pressure control chamber 16 that fluidly communicates with the cylinder 9. The orifice plate 4 includes an inlet orifice 17 and outlet orifice 18 upstream and downstream of the pressure control chamber 16, respectively, as shown in FIG. 1. The inlet orifice 17 is located between a fuel path 12 where the high-pressure fuel is fed and the pressure control chamber 16. The outlet orifice 18 is formed upward of the pressure control chamber 16 to fluidly intermediate between the pressure control chamber 16 and the discharge path 13 (lower pressure end).

(Explanation of Electromagnetic Valve)

The electromagnetic valve 5 includes a ball valve 23 (opening/closing valve) that opens and closes the outlet orifice 18, and an electromagnetic actuator for driving the ball valve 23. The electromagnetic actuator contains, an armature 24, a valve body 25, a spring 26, a solenoid 27, etc. To the lower end of armature 24, the ball valve 23 is attached. The valve body 25 supports the armature 24 to be upward and downward slidable. The spring 26 biases the armature 24 downward (direction for closing the valve). The solenoid 27 drives the armature 24 upward (direction for opening the valve). The electromagnetic actuator is assembled over the nozzle holder 2 via the orifice plate 4, and is fastened over the nozzle holder 2 by a retaining nut 28.

The solenoid 27 includes: the coil 31 generating magnetomotive force by conducting electric current; the stator core 32 that sucks the moving core 34 (to be described later) of the armature 24 by the magnetomotive force; and a stopper 33 of a ferromagnetic material (e.g., SCM 415) that excels in fatigue strength and contacts and fits with the armature 24 when the armature 24 is sucked. The stator core 32 is a SMC formed by solidifying iron powder and resin powder, and contains the coil 31 that is wound around a bobbin and molded by a resin etc. Here, the composition and manufacturing method will be explained later.

The armature 24 is formed by integrating the moving core 34 having a magnetism property with the shaft 35. Here, the moving core is magnetically sucked by the stator core 32; the shaft 35 is supported to be axially slidable by the valve body 25. The moving core 34 is formed by solidifying the sintered metal formed by power metallurgy, and connected with the edge of the shaft 35 made of steel excelling in abrasion resistance. Here, the compositions and manufacturing methods of the moving core 34 and the shaft 35 will be explained later.

When the solenoid 27 is in an OFF state, the armature 24 is downward biased by biasing force of the spring 26, so that the ball valve 23 is seated on the top surface of the orifice plate 4 to occlude the outlet orifice 18. When the solenoid 27 is in an ON state, the armature 24 upward moves against the biasing force of the spring 26, so that the ball valve 23 is lifted upward from the top surface of the orifice plate 4 to open the outlet orifice 18.

(Explanation of Operation of Fuel Injection Valve)

The high-pressure fuel fed from the common rail into the fuel injection valve 1 is introduced to an internal path 29 (shown in FIG. 2) and the pressure control chamber 16. Here, when the electromagnetic valve 5 is in an OFF state (where the ball valve 23 is closing the outlet orifice 18), the pressure of the high-pressure fuel introduced to the pressure control chamber 16 is applied to the needle 7 via the control piston 3 to strongly downward (direction for closing the valve) bias the needle 7 along with the spring 15.

By contrast, the high-pressure fuel introduced to the internal path 29 of the nozzle is applied to a pressure accepting surface (effective seating area of the nozzle) of the needle 7 to strongly upward (direction for opening the valve) push the needle 7. Here, when the electromagnetic valve 5 is in a closing state, a force that downward pushes the needle 7 is greater than the above, so that the needle 7 is maintained to be closing the injection hole 6*a* without being lifted. The fuel is thereby not injected.

When the electromagnetic valve 5 is turned ON, the ball valve 23 opens the outlet orifice 18, so that the orifice 18 is fluidly communicated with the discharge path 13. The fuel of the pressure control chamber 16 is thereby discharged via the outlet orifice 18 to the discharge path 13, so that the pressure of the pressure control chamber 16 is decreased. As the pressure of the pressure control chamber 16 is decreased to a given pressure enabling opening the valve, the force lifting the needle 7 surpasses the downward biasing force. The needle 7 thereby lifts to open the injection hole 6*a*, so that injection of the fuel is started.

When the electromagnetic valve 5 is turned OFF, the ball valve 23 closes the outlet orifice 18, so that the pressure of the pressure control chamber 16 is increased. As the pressure of the pressure control chamber 16 is increased to a given pressure enabling closing the valve, the downward biasing force surpasses the lifting force. The needle 7 thereby falls to close the injection hole 6*a*, so that injection of the fuel is stopped.

(Explanation of Armature 24)

The armature 24, as explained above, includes the shaft 35 that is supported to be axially slidable by the valve body 25, and the moving core 34 fastened to the shaft 35. The soft magnetic material constituting the moving core 34 is formed by silicon steel containing silicon in iron. This example 1 uses silicon steel (1LSS to 3LSS) containing silicon from one weight % to three weight % both inclusive (corresponding to from 3.3 volume % to 10.0 volume % both inclusive). Here, conversion from weight % to volume % is performed based on a density of the silicon of 2.33 (25° C.).

The soft magnetic material constituting the moving core 34 is sintered metal formed by a method of powder metallurgy. Namely, the moving core 34 of the example 1 is formed by molding by compression sintered metal of silicon steel containing silicon from one weight % to three weight % both inclusive to form a compressed powder body, and then by sintering and solidifying it. The moving core 34 thereby excels in a magnetism property (static suction force, dynamic suction force). By contrast, the shaft 35 of the example 1 is steel made of a ferromagnetic material.

Figure 3:
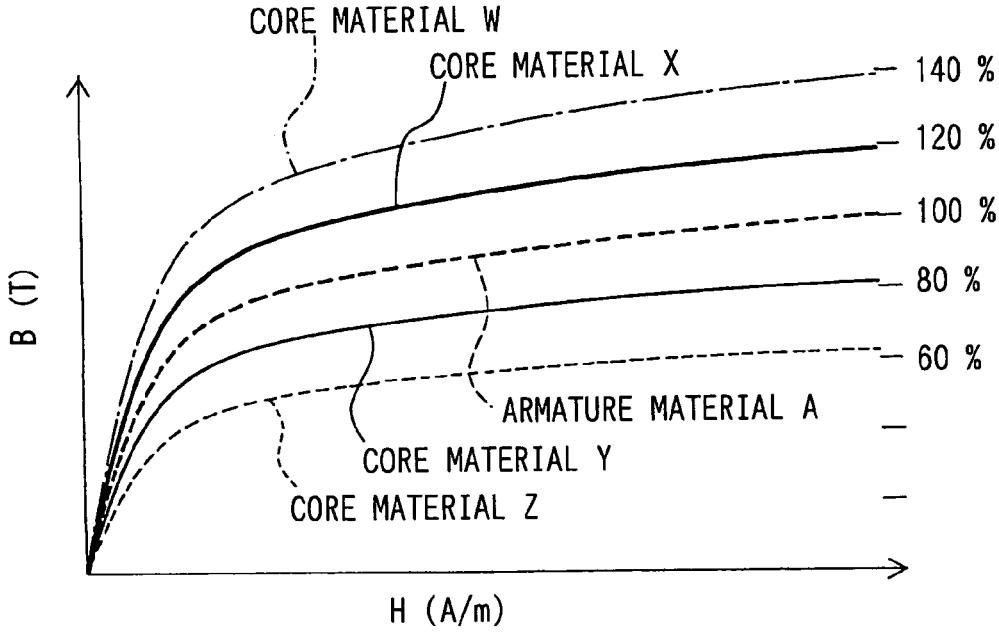
FIG. 3 is a graph showing a direct current magnetism property (B-H property) between an armature and stator core.

Thus, the moving core 34 is formed by solidifying sintered metal of silicon steel containing silicon from one weight % to three weight % both inclusive and the shaft 35 is formed of a ferromagnetic material, so that the armature 24 is increased in the magnetism property to thereby obtain a direct current magnetism property (B-H property) as shown in a dotted line A in FIG. 3. Namely, the response and suction force of the armature 24 are enhanced.

When the response and suction force of the armature 24 are enhanced, a period for opening the valve is shortened and a period for closing the valve is also shortened by increasing the biasing force of the spring 26. Namely, the response of the electromagnetic valve 5 can be enhanced, so that a fuel injection valve 1 having a quick response can be achieved.

Here, the moving core 34 formed of the sintered metal is integrated with the shaft 35 by sintering connection. The shaft 35 is steel excelling in abrasion resistance and fatigue resistance. The shaft 35 needs higher fatigue strength since the shaft 35 repeatedly undergoes impacts when being seated. The mechanical strength can be enhanced by increasing hardness. Here, the shaft 35 is jointed with the moving core 34 of the sintered metal and then connected by sintering, so that the shaft 35 possibly undergoes significant composition changes such as enlarging crystal grains during the high-temperature sintering. Therefore, steel is preferably required to recover hardness by a thermal treatment posterior to the integration.

From the above standpoint of views, the steel forming the shaft 35 preferably adopts, e.g., high-speed tool steel etc, that includes a ferromagnetism property and is capable of recovering the hardness by the thermal treatment of quenching etc. In detail, steel kinds are preferably selected from those specified as SKH materials in JIS (Japanese Industrial Standards). Here, any one of alloy tool steel, martensitic stainless steel, or bearing steel can be substituted for the high-speed tool steel, since they can obtain the effect resembling to that of the high-speed tool steel.

The sintering connection between the moving core 34 of the sintered metal and the shaft 35 will be explained below. The sintering has functions: advancing diffusion connection between powders of the compressed powder body to increase strength and a magnetism property due to enhancing fineness; and fulfilling diffusion connection between the compressed powder body and the shaft 35. When the sintering temperature is below 1000° C., the above enhancing fineness cannot be sufficiently fulfilled, which results in insufficient strength and an insufficient magnetism property. Further, it results in insufficient diffusion connection. Therefore, a lower limit of the sintering temperature is set to 1000° C., much preferably to not less than 1100° C.

By contrast, as the sintering temperature increases, the diffusion between the shaft 35 and the sintered metal advances to thereby achieve strong connection. However, when the temperature is excessively high, recovering the hardness by a thermal treatment becomes impossible even when the shaft 35 adopts high-speed tool steel. Consequently, a higher limit of the sintering temperature is set to 1300° C. When the sintering temperature is below 1300° C., the hardness can be recovered by applying a thermal treatment of quenching and tempering after the integration by sintering. The high abrasion resistance and high fatigue strength to repeated impacts that are required by the shaft 35 are thereby obtained. The higher limit of the sintering temperature is much preferably set to not more than 1200° C.

Further, regarding atmospheric gas for sintering, an oxidizing atmosphere decreases iron (Fe) by oxidizing it within the compressed powder body to thereby decrease the magnetism property, so that non-oxidizing atmosphere is required to be prepared. Further, even when the non-oxidizing atmosphere is prepared, an atmospheric gas having a carburization property diffuses carbon (C) into the iron (F) within the compressed powder body to decrease the magnetism property. Further, the diffusion of the above carbon (C) also develops a tendency of expansion in the compressed powder body during the sintering, so that the connection with the shaft 35 becomes insufficient. Accordingly, the sintering atmosphere is preferably non-oxidizing atmosphere excluding the atmospheric gas having the carburization property.

The dimension difference in connecting and fitting between the shaft 35 and the compressed powder body is important. Namely, the dimension difference means that between an internal diameter of the internal hole of the compressed powder body and the outer diameter of the shaft 35. It is preferable that, before sintering, the internal diameter of the internal hole of the compressed powder body is set to less and the shaft 35 is pressed and inserted into the internal hole. As a length by which the shaft 35 is inserted into the internal hole increases, a degree of adhesion between the shaft 35 and moving core 34 is increased. However, for preventing the damage of the compressed powder body that has a weak structure, the length is preferably set to not more than 20 μm, much preferably not more than 5 μm.

A manufacturing method of the armature 24 will be explained below. At first, a compressed powder body is generated to have an internal hole by molding sintered metal powder by compression using a metal mold where a lubricating agent is applied (Moving core manufacturing process). The shaft 35 is then inserted into the internal hole of the compressed powder body (Shaft inserting process). The moving core 34 formed by solidifying the compressed powder body and the shaft 35 are then integrated by applying a heating treatment at temperature between 1000 to 1300° C. to them under the non-oxidizing atmosphere excluding the carburizing gas atmosphere (Sintering process). Further, by applying the quenching and tempering processes to them, the high abrasion resistance and high fatigue strength against repeated impacts that are required for the shaft 35 are recovered (Thermal treatment process). Finally, by applying a cutting process or a grinding process to the moving core 34, the armature 24 is finished (Finishing process). By the above processes, the armature 24 of the electromagnetic valve 5 is manufactured.

(Explanation of Stator Core 32)

The stator core 32 is the SMC formed by solidifying iron powder and resin powder, as explained above.

(Explanation of Iron Powder)

The iron powder used for the SMC of the stator core 32 can include iron powder by a atomization method, a reduction method, etc. (atomized iron powder, reduced iron powder). The particle diameter of the iron powder is selected depending on a required magnetic flux density etc. Although a particle diameter of not more than 200 μm typically used in powder metallurgy is also used in this example, a particle diameter of not more than 150 μm is used in consideration of a compression property. Since an eddy current loss decreases with decreasing particle diameter of the iron powder, the particle diameter is preferably set to mot more than 100 μm. Although the lower diameter is unnecessarily limited, a diameter distribution mainly having smaller diameters worsens a compression property of the compressed powder and a fluid property of the powder, disabling a highly dense compressed core. It is thereby preferable that a particle diameter of the powder be not less than 1 μm.

When iron powder whose surface is coated by a phosphoric compound is used, the coating film functions as an insulating layer to have an effect suppressing generation of eddy currents between iron particles. This effect is further enhanced due to existence of a resin for connection. As the phosphoric compound for coating the iron powder, phosphoric iron, phosphoric manganese, phosphoric zinc, phosphoric calcium, etc. are preferably adopted. The phosphoric-compound-coated iron powder in marketed production can be used.

(Explanation of Resin Powder)

For the resin powder used for the SMC of the stator core 32, either polyphenylene-sulfide (hereinafter, polyphenylene-sulfide is referred to as PPS) excelling in heat resistance or thermo-plastic polyimide (hereinafter, polyimide is referred to as PI) exhibits an excellent property to be thereby preferably adopted. Long-time usage of the stator core 32 formed of the SMC under high temperatures (e.g., exceeding 180° C.) possibly entails changes over time in the shape or dimensions in the stator core 32 or deteriorates an insulating property in the stator core 32. The reason for these changes over time is assumed to be derived from complicated remaining stress generated during the molding by compression. The reason for deteriorating the insulating property is assumed to be derived from decrease of the thickness of the insulating resin between the iron particles.

To solve these problems, mixing into the PPS or thermo-plastic PI a resin having a high glass transition temperature can be effective. This is because a mixed state where resins between the iron particles have different thermal properties possibly causes difficulty in generating shape change or movement during the usage. Here, a content ratio of the resin having the high glass transition temperature should be within a range not exceeding the amount of the primary material (PPS, thermo-plastic PI). When the PPS and thermo-plastic PI are mixed and used, the resins between the iron particles generates the above-described mixed state including the different thermal properties, possibly suppressing deformation or movement under the usage. The above problems are thereby improved.

Further, as the resin having the glass transition temperature higher than the thermo-plastic PI, for example, non-thermo-plastic PI, polyamide-imide, polyamino-bismale-imide, etc. can be used. Further, as the resin having the glass transition temperature higher than the PPS, for example, polyphenylene-oxide, polysulfone, polyether-sulfone, polyarylate, polyether-imide, non-thermo-plastic PI, polyamide-imide, polyamino-bismale-imide, etc. can be used.

(Explanation of Mixture of Iron Powder and Resin Powder)

The resin powder functions as a binding agent, and also suppresses generation of eddy currents by insulating spaces between iron particles. The iron powder where the phosphoric compound is coated possibly undergoes breakage of insulation due to peeling or omission during the powder compression formation. However, existence of the resin protects the breakage of the insulation to thereby suppress the generation of the eddy currents.

The resin powder is mixed as powder during manufacturing. At this time, decreasing particle diameters of the resin powder enhances a mixed state and heat resistance. Further, another can be adopted, namely resin powder being coated by an organic solvent (e.g., n-methyl-2-pyrrolidone) is produced and mixed with resin power being not coated with the organic solvent. By using the resin powder being coated by the organic solvent, the insulating property can be enhanced.

(Forming Compressed Powder Body)

The compressed powder body formed by compressing the iron powder and resin powder is formed by compression using a metal mold. At the compression formation, it is preferable to apply a lubricating agent to the surfaces of a metal mold in the same manner as that generally used in powder metallurgy to enhance compressibility or to decrease abrasion when extracting the compressed powder body. Here, an example of applying the lubricating agent can include a technology of applying forming powder such as stearic zinc, ethylenebis-stearamide to the metal mold by an electrostatic application etc. Further, higher dense formation can be achieved by any one of the following manners: (1) a manner where resin powder for connection is heated at temperatures at which the resin power does not melt, (2) a manner where the first compression formation is performed without heating the resin powder and resin-coated iron powder and the second compression formation is then performed while heating but not melting the resin powder, and (3) a manner where the compression formation is performed while heating the resin to temperatures at which the resin is softened and melted.

As a process posterior to the above formation, a method can be adopted where a heating treatment (to be described later) is applied after cooling the formed body (compressed powder body) to the room temperature. Further, a method can be also adopted where a heating treatment is applied while the formed body being still hot after the formation, which can eliminate an energy loss and cooling period.

(Heating Treatment)

In the heating treatment, the resin for connection is melt and stabilization of a resin property is aimed by crystallization of the resin for connection. The heating temperature and period are selected depending on a kind of the resin used. The temperature is within a range from the melting point to a temperature at which the resin is not thermally deteriorated, i.e., 250 to 400° C. for PPS, 300 to 450° C. for thermoplastic PI. The heating period is approximately 0.5 to 1 hour.

The atmosphere during the heating can be the air. However, oxygen within the air possibly decreases a strength and mechanical property of the resin. This is because the existence of the oxygen advances polymerization reaction of the resin and possibly generates gaseous condensates to be occluded within the resin. Therefore, before heating in the air, heating in inert gasses such as nitrogen is preferably adopted. Further, heating in a depressurized atmosphere decreases an oxygen amount within the atmosphere and dispels gaseous condensates from the resin. These atmospheric states can be adopted by being combinied mutually as needed. In a cooling stage of the heating treatment, cooling under a temperature region from 320 to 150° C. with a long period consumed can also function as a thermal treatment for stabilization.

(Thermal Treatment Process for Stabilization)

The thermal treatment stabilizes a property of the resin connecting iron particles of the iron powder, and suppresses changes over time of the stator core 32 formed of the SMC when the stator core 32 is used at high temperatures. Here, a method is adopted where the compressed powder body is maintained at approximately 150 to 320° C. for one to two hours after being cooled posterior to the heating treatment.

(Finishing Process)

By applying the cutting process or grinding process to the stator core 32 manufactured as the above-described processes, the stator core 32 is finished. The stator core 32 of the electromagnetic valve 5 is manufactured by the above processes.

As explained above, to the iron powder (or iron powder whose surface a phosphoric compound coating is applied to), various combinations of resins are added, e.g, PPS alone; thermo-plastic PI alone; a mixture of these PPS and thermo-plastic PI; a mixture of either of these PPS and thermo-plastic PI resin and a resin having higher glass transition temperature than the either of these resins; and a mixture of these resins (PPS and thermo-plastic PI) and a resin having higher glass transition temperature than the PPS. Here, a stator core 32 having high magnetism transmissivity, and high mechanical strength can be provided by controlling a resin content to be not more than 0.1 weight %. This stator core 32 has the mechanical strength, so that it hardly entails cracks or fractures even when a cutting process, grounding process, or drilling process take place. Further, when the stator core 32 is used under a high temperature environment as a fuel injection valve 1 attached to an engine, the high magnetism property can be maintained and there are no decrease of the strength and no changes in dimensions. Also, the cost can be suppressed.

(Feature of Example 1)

As explained above, the armature 24 of the example 1 enhances the magnetism property of the armature 24 itself by even adopting the shaft 35 formed of a ferromagnetic material. Further, the armature 24 includes the moving core 34 formed of sintered metal whose iron powder is formed of silicon steel (1LSS to 3LSS), so that the magnetism property of the armature 24 itself can be extremely enhanced.

Figure 4:
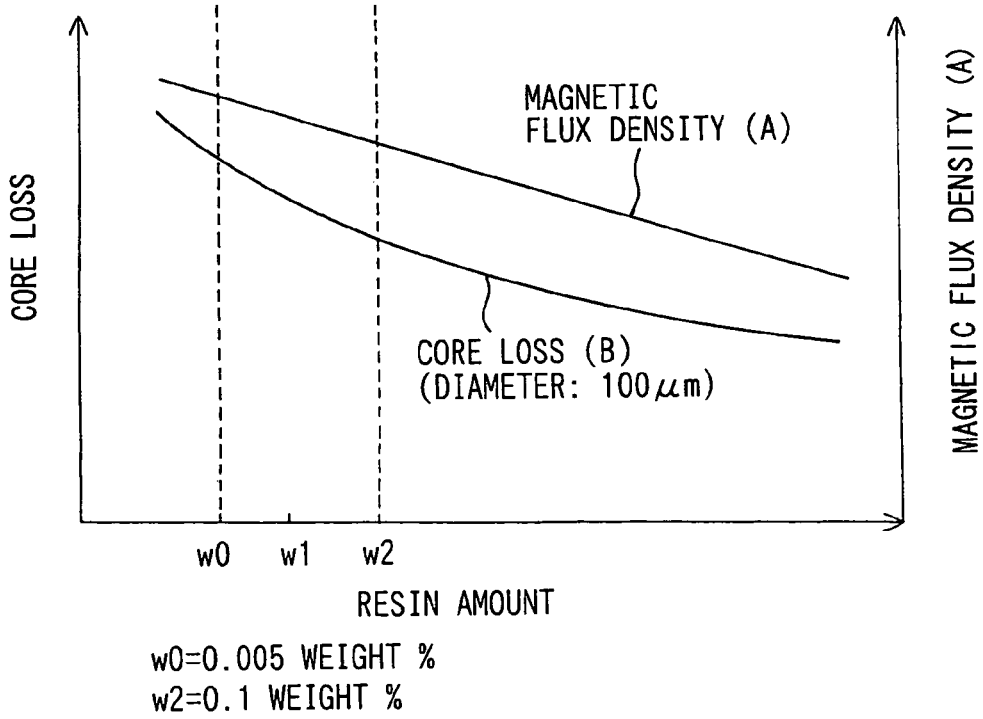
FIG. 4 is a graph showing a relationship of a resin content ratio with a core loss and magnetic flux density.

The stator core 32 is consequentially required to meet the armature 24 excelling in the magnetism property. As shown in a solid line (A) in FIG. 4, it is known that as a resin content ratio decreases, a magnetic flux density increases and static suction force increases. However, as shown in a solid line (B), as a resin content ratio decreases, a core loss affecting a dynamic suction force unfavorably increases. Therefore, as the resin content ratio decreases, a response of an electromagnetic valve 5 worsens due to increase of the core loss although the magnetic flux density increases. It thereby becomes impossible to provide a fuel injection valve 1 excelling in response. By contrast, as the resin content ratio increases, the magnetic flux density also decreases although the core loss decreases. The suction force is thereby decreased and the response is deteriorated. Thus, conventionally, it is difficult to reconcile the high magnetic flux density and the low core loss with each other.

Figure 5:
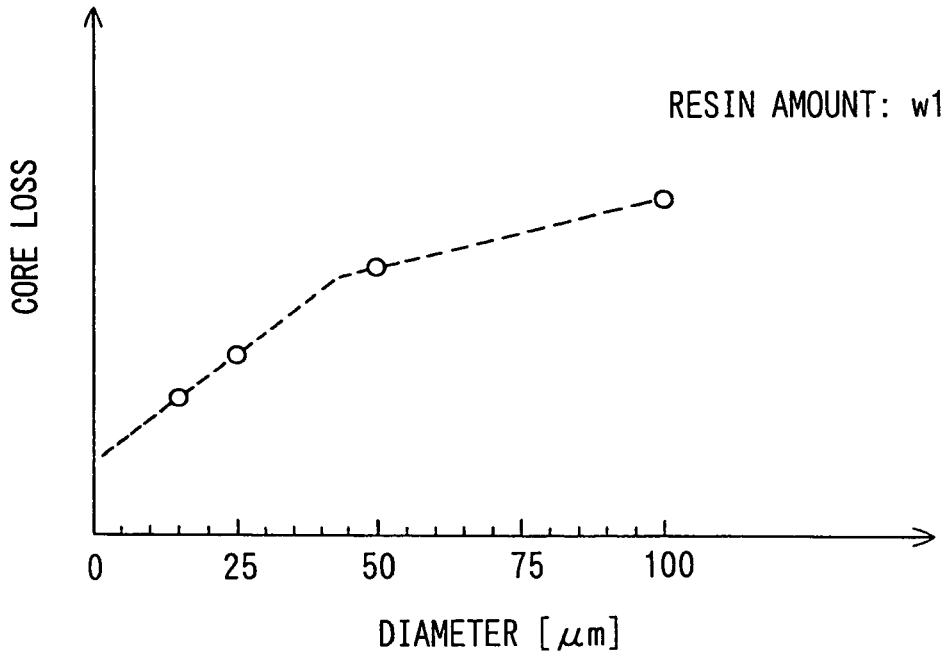
FIG. 5 is a graph showing a relationship of a resin particle diameter with a core loss.

The inventors of this application found that a relationship between the resin content ratio and the core loss remarkably depends on a resin particle diameter. In detail, as shown in FIG. 5, under a state where a resin content ratio is maintained to be w1, as the particle diameter of the resin is decreased, the core loss can be suppressed. Further, the effect for suppressing the core loss rapidly increases in a range of not more than 50 μm.

Figure 6:
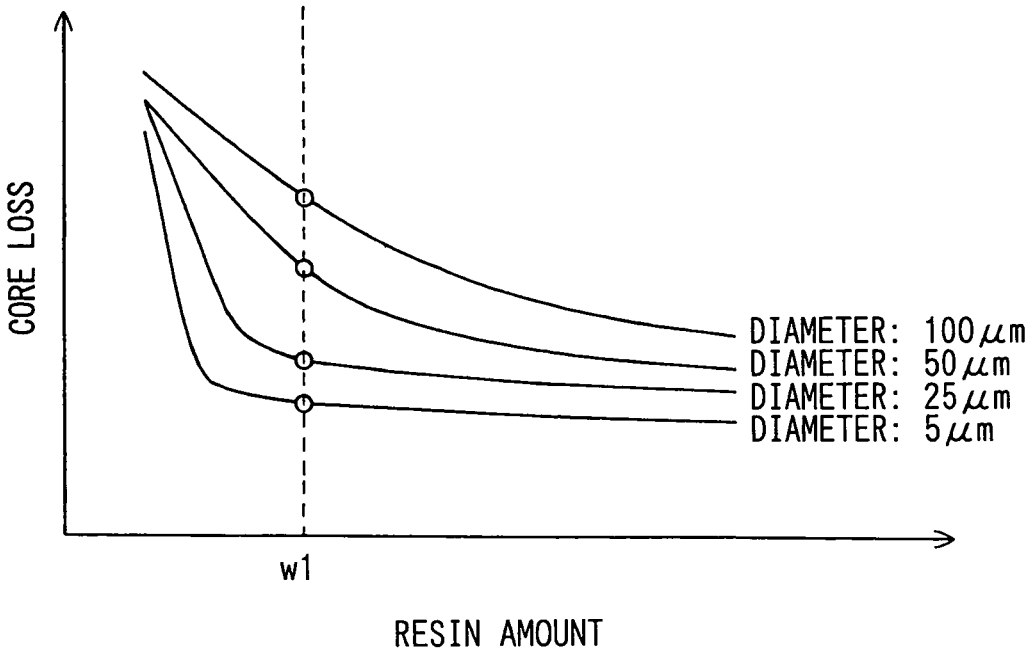
FIG. 6 is a graph showing a relationship of a resin content ratio with a core loss when a resin particle diameter is changed.

When the resin particle diameter and resin content ratio are varied, the core loss can be decreased with decreasing resin particle diameter under a state where the resin content ratio is decreased, as shown in FIG. 6. In particular, it is found that a curve having a downward convex portion (large curvature) is formed while the resin particle diameter is not more than 50 μm; further, it is found that a curve having a sharp convex portion is formed while the resin particle diameter is not more than 25 μm.

Figure 7:
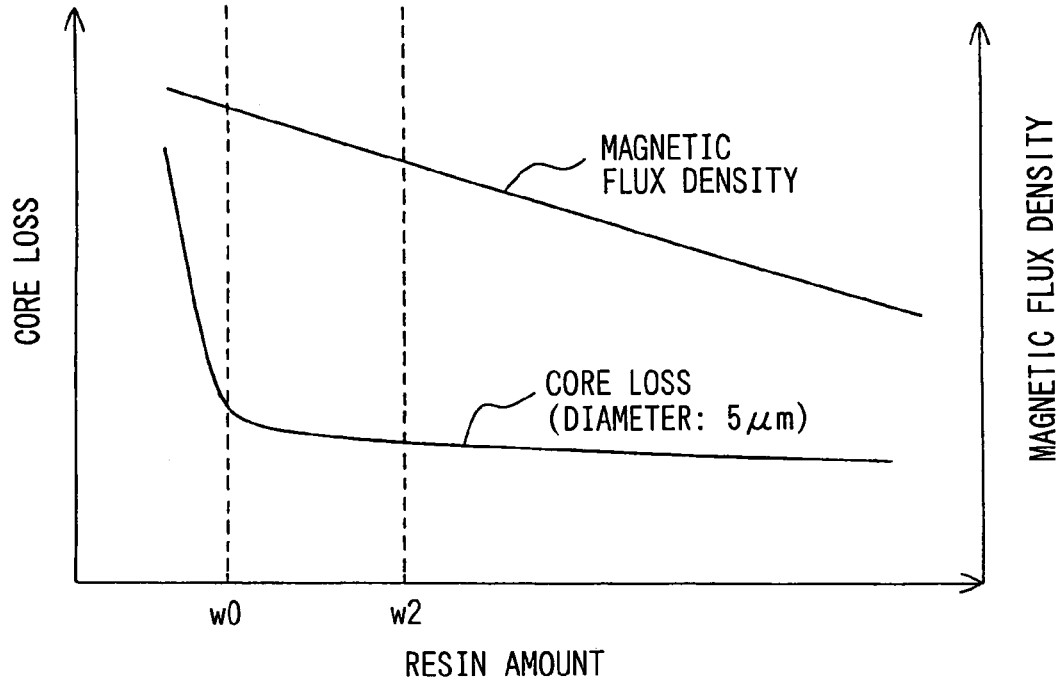
FIG. 7 is a graph showing a relationship of a resin content ratio with a core loss and magnetic flux density.

Selected examples of the detailed resin content ratio and resin particle diameter will be explained with reference to FIGS. 6, 7. As the resin content ratio decreases, the magnetic flux density increases and the suction force thereby increases. As shown in FIG. 7, at first, a range (w0 to w2) of the resin content ratio that exhibits a high magnetic flux density is determined. This range w0 to w2 of the resin content ratio is suitably determined to be from 0.005 weight % to 0.1 weight % both inclusive (comparable to from 0.03 volume % to 0.6 volume % both inclusive). Here, the conversion from weight % to volume % is based on an iron density of 7.87 (25° C.) and a thermo-plastic PI density of 1.30 (25° C.).

By contrast, when the resin content ratio is constant, the core loss is decreased with decreasing resin particle diameter, as read from FIG. 5. Therefore, to increase the magnetism property while suppressing the core loss of the stator core 32, decreasing a particle diameter of the resin powder as far as possible is favorable. As described above, since the effect suppressing the core loss is increased with a resin particle diameter of not more than 50 μm, a range from 0.005 μm (possibly minimum diameter) to 50 μm both inclusive is favorable.

In particular, since the resin particle diameter is required to be not more than 25 μm so as to increase the magnetism property while suppressing the core loss of the stator core 32, a range from 0.005 μm to 25 μm both inclusive is favorable. However, excessively decreasing the particle diameter of the resin powder involves difficulty in manufacturing the resin powder, so that the cost of the resin powder remarkably increases. Therefore, to increase the magnetism property while suppressing the core loss and suppressing the increase of the cost, a range from 5 μm to 25 μm both inclusive is favorable. Thus, to increase the magnetism property while suppressing the core loss in the stator core 32, a range not more than 25 μm is favorable. To suppress the cost of the resin powder, a range not less than 5 μm is favorable. Therefore, a range from 5 μm to 25 μm both inclusive is favorable to reconcile the cost and magnetism property with each other.

In this example 1, to keep the magnetic flux density high, the particle diameter of the resin powder or resin content ratio is controlled under the resin content ratio being kept low (e.g., the resin content ratio from 0.005 weight % to 0.1 weight % both inclusive). The direct current magnetism property of the stator core 32 is thereby controlled for being approximately equivalent to the direct current magnetism property of the armature 24.

In detail, as shown in FIG. 3, when the direct current magnetism property (B-H property) of the armature 24 is assumed to be 100%, the direct current magnetism property (B-H property) of the stator core 32 is controlled to be within a range from 80% to 120% both inclusive. Namely, when the direct current magnetism property of the armature 24 is shown in a dotted line A in FIG. 3, the direct current magnetism property of the stator core 32 is set within two solid lines X,Y.

When the direct current magnetism property of the armature 24 is shown in a dotted line A in FIG. 3 and the stator core 32 is formed by minimizing the resin particle diameter in such a manner that its direct current magnetism property follows a solid line W, the magnetism property of the stator core 32 comes to show an excessive magnetism property relative to that of the armature 24. Thus, even when the magnetism property of the stator core 32 is increased, the suction force and valve response of the armature 24 is determined by the magnetism property of the armature 24 that is inferior to that of the stator core 32. Therefore, the capability of the stator core 32 that is increased by consuming the high cost becomes useless, i.e., the manufacturing cost of the stator core 32 uselessly increases without deserving of the increased capability of the electromagnetic valve 5.

By contrast, it is supposed that the stator core 32 is formed to be inferior to that of the moving core 34 as shown in a solid line Z in FIG. 3 by slightly increasing a resin content ratio of the stator core 32, increasing the resin particle diameter, or the like. Here, the capability of the electromagnetic valve 5 is determined by the magnetism property of the stator core 32 being inferior. The electromagnetic valve 5 cannot thereby exhibit sufficient capability.

The next tables 1, 2 show the results of the suction force and valve response of the armature 24 that are measured in such a manner that the stator core 32 having the magnetism properties shown in dashed line W, solid line X, solid line Y, and dotted line Z.

TABLE 1

| Static Suction | CORE MATERIAL | | | |
|---|---|---|---|---|
| Force [N] | W | X | Y | Z |
| Armature Material | 99 | 96 | 66 | 46 |

TABLE 2

| Valve | CORE MATERIAL | | | |
|---|---|---|---|---|
| Response [μs] | W | X | Y | Z |
| Armature Material | 175 | 180 | 220 | 275 |

(Effect of Example 1)

As explained above, in the example 1, the direct current magnetism properties of the stator core 32 and armature 24 are approximately equivalent to each other by controlling the magnetic density or core loss of the stator core 32 even when the magnetism property of the armature 24 is increased. This is done by controlling the resin content ratio and resin particle diameter of the SMC constituting the stator core 32. Thus, approximately equalizing the direct current magnetism properties of the stator core 32 and armature 24 enables the magnetic capability of the stator core 32 and armature 24 to be effectively performed, providing an excellent fuel injection valve 1 that well balances the cost and capability with each other.

EXAMPLE 2

In the above example 1, the resin powder of the SMC constituting the stator core 32 includes any one of the following:

(1) PPS (2) Thermo-plastic PI (3) Mixture of PPS and thermo-plastic PI (4) Mixture of PPS and a resin having a glass transition temperature higher than PPS (5) Mixture of thermo-plastic PI and a resin having a glass transition temperature higher than thermoplastic PI (6) Mixture of PPS, thermo-plastic PI, and a resin having a glass transition temperature higher than PPS.

By contrast, in an example 2, the resin powder of the SMC constituting the stator core 32 includes either one of the following:

(1) Thermoset PI (2) Mixture of thermoset PI and polytetrafluoro-ethylene (hereinafter referred to as PTFE).

Further, the iron powder of the stator core 32 (SMC) uses atomized iron and reduced iron.

The powder and compressed powder samples used for experiments for producing the stator core 32 will be explained regarding their manufacturing methods and property measuring methods below.

1. Iron Powder (1) Atomized iron powder, having particle diameters of not more than 200 μm, formed of an insulating thin surface coating of a phosphoric material (2) Reduced iron powder, having particle diameters of not more than 200 μm, formed of an insulating thin surface coating of a phosphoric material.

2. Resin Powder (1) Thermo-plastic PI powder having an average particle diameter of 20 μm (2) Thermoset PI powder having an average particle diameter of 20 μm (3) PTFE powder having an average particle diameter of 5 μm.

3. Powder Formation (Forming Compressed Powder Body)

It is executed by the following: forming a liquid by dispersing a forming lubricating agent powder within an alcohol; applying the liquid to an inside surface of a shaping metal mold heated to 100° C.; drying the metal mold; filling the metal mold with a heated mixture of iron powder and resin powder; and forming by compression the mixture at a pressure of 1560 MPa.

4. Thermal Treatment of Compressed Powder Body (1) Compressed powder body including thermal-plastic PI: 400° C.×1 hour, under nitrogen gas (2) Compressed powder body including thermoset PI: 200° C.×2 hours, under air.

5. Sample

A cutting process is applied to an internal surface and edge surface of the thermal-treated SMC to thereby form a sample of an inside diameter of 10 mm, an outside diameter of 23 mm, a height of 10 mm.

6. Property (1) Magnetic flux density (T): measured value at a magnetic field of 8000 A/m (2) Core loss (iron loss: $kW/m^3$): measured value at applied magnetic flux density of 0.25 T (tesla), at a frequency of 5 kHz (3) Radial crushing strength (MPa): according to JIS Z2507-1979 (test method for radial crushing strength of sintered oil retaining bearing steel)

(4) Density ($Mg/m^3$): according to JIS Z2505-1979 (test method for sintered density of sintered metal material).

Hereinafter, property graphs will be referred to for explanation below.

1. Kind and Content Ratio of Resin

Figure 8:
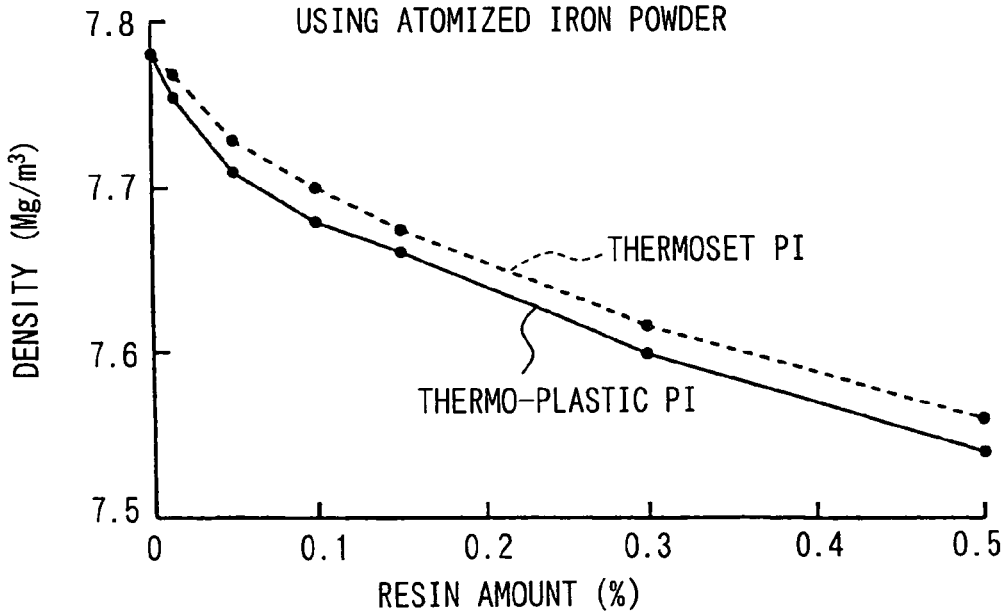
FIG. 8 is a graph showing a relationship of a resin content ratio with a density when atomized iron powder is used.
Figure 9:
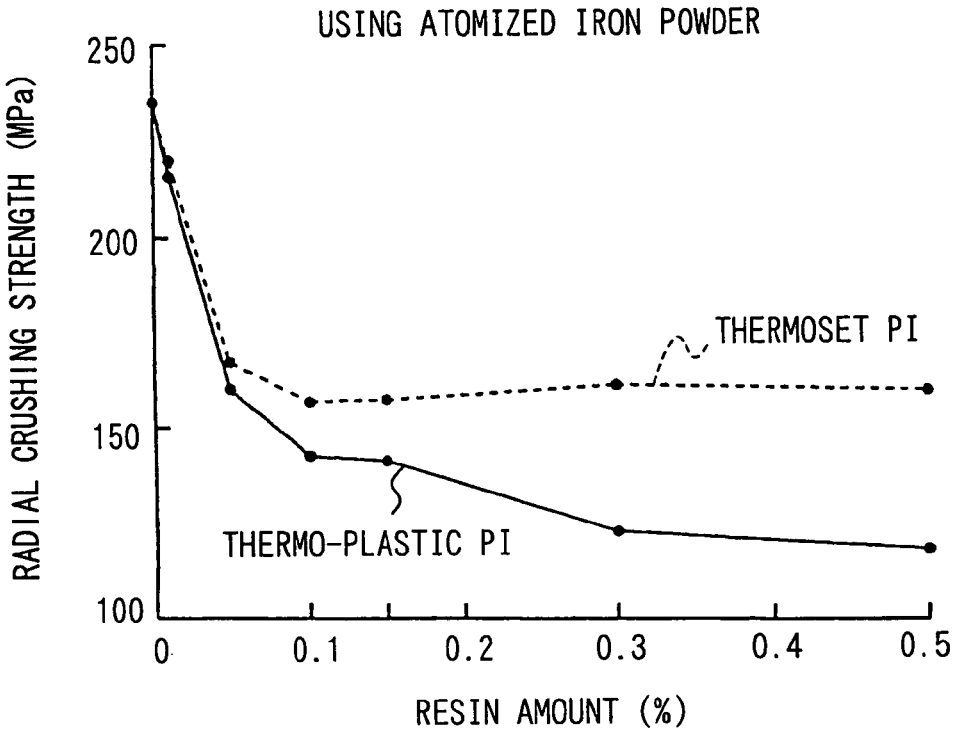
FIG. 9 is a graph showing a relationship of a resin content ratio with a radial crushing strength when atomized iron powder is used.

Properties of a compressed powder core are shown in FIGS. 8 to 11, regarding when atomized iron powder is used, and a content ratio of thermoplastic PI and thermoset PI is varied. As shown in FIG. 8, as the content ratio of the resin increases, the density decreases. The density is increased by using thermoset PI. As the resin content increases, the radial crushing strength is decreased, as shown in FIG. 9. With respect to thermo-plastic PI, as the resin content increases, the radial crushing strength is decreased; however, with respect to thermoset PI, even when the resin content is not less than 0.1 weight %, the radial crushing strength is kept almost constant.

Figure 10:
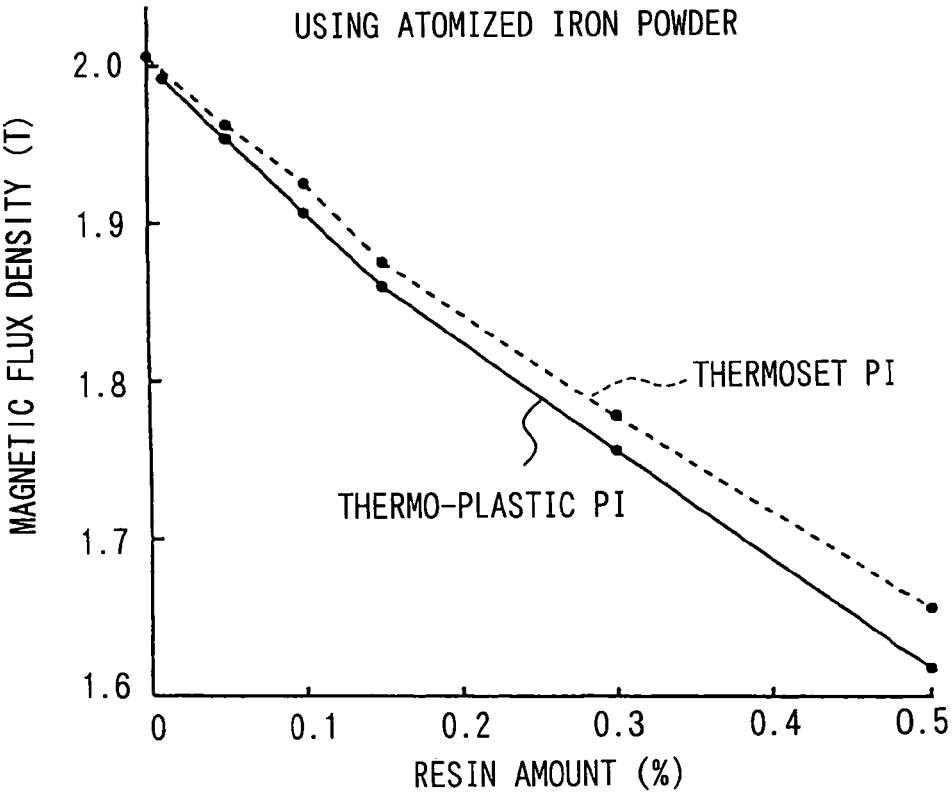
FIG. 10 is a graph showing a relationship of a resin content ratio with a magnetic flux density when atomized iron powder is used.

In FIG. 10 showing a magnetic flux density, as the resin content ratio increases, the magnetic flux density is decreased. The decrease of the magnetic flux density with respect to thermoset PI is smaller than that in thermo-plastic PI. This magnetic flux density is correlative with the density shown in FIG. 8.

Figure 11:
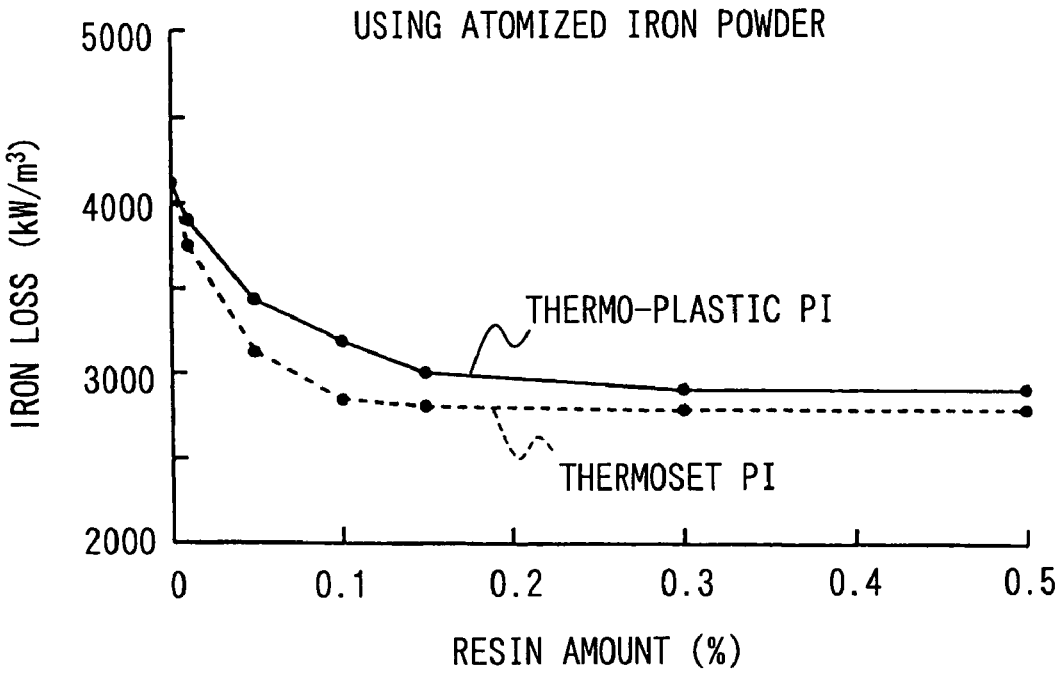
FIG. 11 is a graph showing a relationship of a resin content ratio with a core loss (iron loss) when atomized iron powder is used.

In FIG. 11 showing a core loss (iron loss), as the resin content increases, the core loss is remarkably decreased and is stabilized at the some content. The core loss is decreased more by using thermoset PI, and is stabilized at the resin content ratio of not less than 0.10 weight %.

Summary of the above experiments is as follows:

(1) Thermoset PI is superior to thermo-plastic PI. Using thermoset PI obtains a higher density, obtains a compressed powder core having a higher magnetic flux density, decreases a core loss, and increases a radial crushing strength.

(2) As the content ratio of thermoset PI decreases, a compressed powder body has a higher density, higher radial crushing strength, and higher magnetic flux density.

(3) A core loss remarkably decreases with increasing thermoset PI content ratio up to 0.1 weight %; however, it does not decrease when the content ratio is not less than 0.15 weight %.

(4) A density, radial crushing strength, and magnetic flux density decrease with increasing thermoset PI content ratio, so that it is favorable that the content ratio of thermoset PI is low.

(5) A coarse surface and a slightly cracked corner are viewed in a compressed powder core after a cutting process, regardless of kinds of resins and content ratios, so that improvement is required.

A property of a compressed powder core using atomized iron powder and reduced iron powder will be explained below. The above compressed powder core using atomized iron powder has not a favorable property for the cutting process. The reason why is supposed that particles of the iron powder are under a state where they easily drop off during the cutting process. Further, it is because the atomized iron powder has a less rugged surface and its specific surface area is relatively small. When reduced iron having a relatively large specific surface area is used, a processed surface exhibits a favorable property in an experiment where a sample of a compressed powder core that is formed similarly with the above undergoes the cutting process. However, when the reduced iron is used, a property of compression of the powder is relatively worsen, so that forming a high density compressed powder core is difficult and a high magnetic flux density cannot be easily obtained.

Based on the above knowledge, mutual effects of a magnetic flux density, core loss, and workability of cutting process when a mixture is formed from atomized iron powder and reduced iron powder will be described below.

Properties of samples of compressed powder cores are shown in FIGS. 12 to 15 with the following conditions: thermoset PI or thermo-plastic PI used as resin powder is contained by 0.1 weight %; and cores are either from only atomized iron powder (i.e., reduced iron powder is zero %) or from a mixture having a ratio of atomized iron powder and reduced iron powder of 1:1 (weight ratio).

Figure 12:
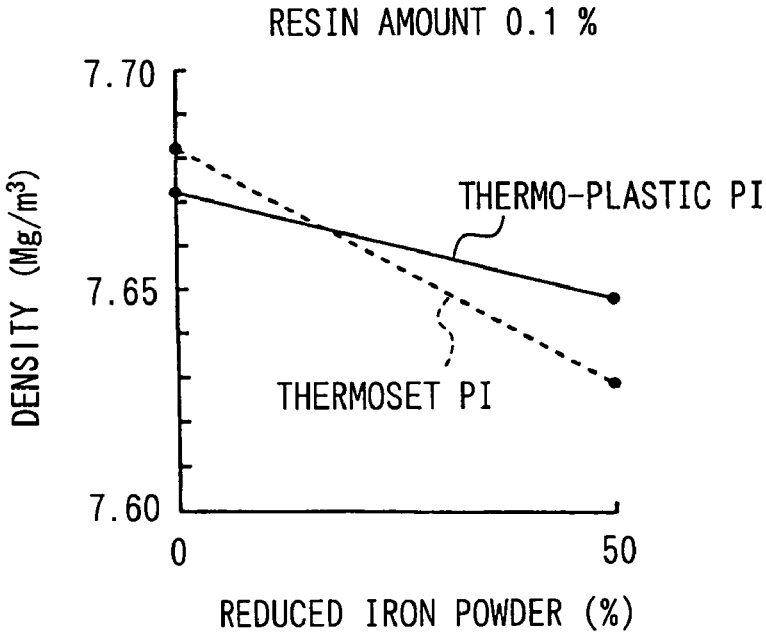
FIG. 12 is a graph showing a relationship of a reduced iron content ratio with a density when thermo-plastic PI or thermoset PI is used.

As shown in FIG. 12 showing a density, the mixture including the reduced iron powder exhibits a lower density than the atomized iron alone. The thermoset PI has a property to exhibit a larger decrease in a density when including the reduced iron powder.

Figure 13:
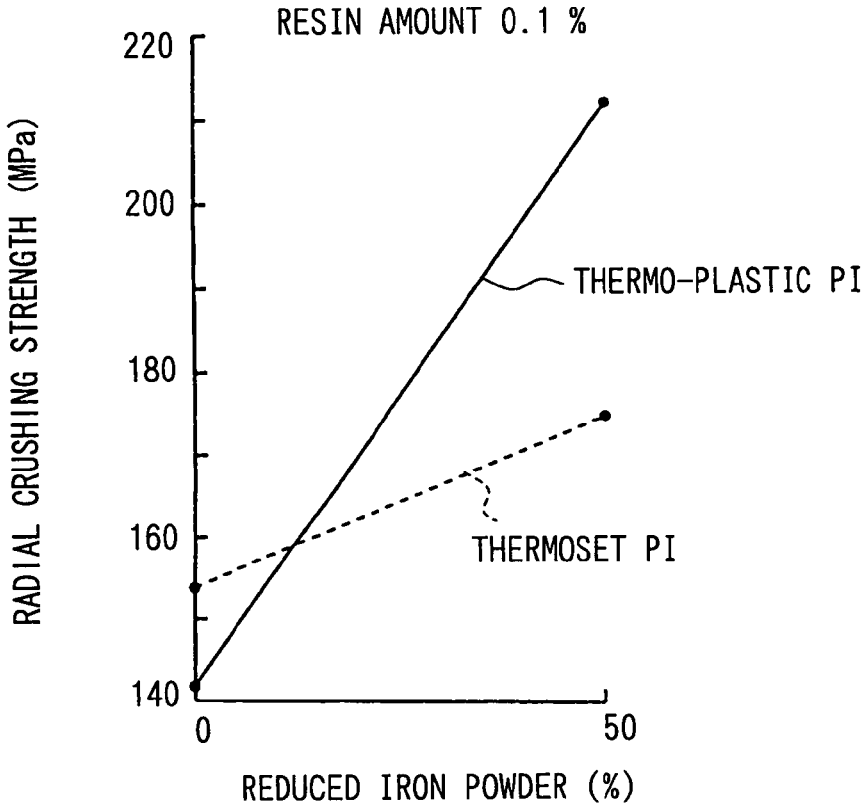
FIG. 13 is a graph showing a relationship of a reduced iron content ratio with a radial crushing strength when thermo-plastic PI or thermoset PI is used.

As shown in FIG. 13 showing a radial crushing strength, the mixture including the reduced iron powder exhibits a higher strength. Further, the sample using the thermoset PI and including the reduced iron powder exhibits a smaller increase tendency in the radial crushing strength.

Figure 14:
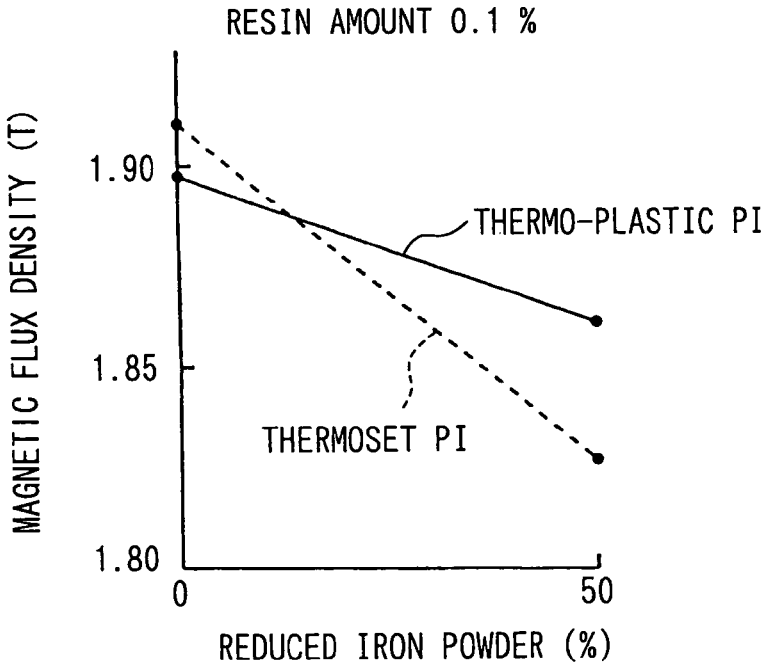
FIG. 14 is a graph showing a relationship of a reduced iron content ratio with a magnetic flux density when thermo-plastic PI or thermoset PI is used.

As shown in FIG. 14 showing a magnetic flux density, the sample including the reduced iron powder exhibits a lower density. Further, the sample including the thermoset PI exhibits a larger decrease when including the reduced iron powder.

Figure 15:
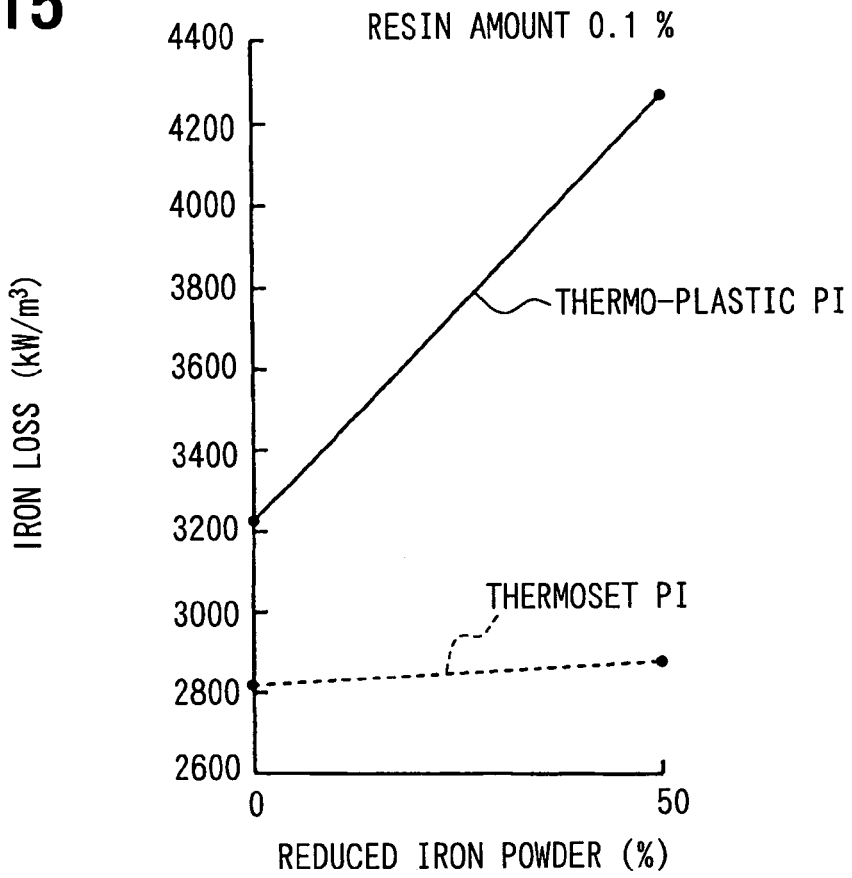
FIG. 15 is a graph showing a relationship of a reduced iron content ratio with a core loss (iron loss) when thermoplastic PI or thermoset PI is used.

As shown in FIG. 15 showing a core loss, the sample including the thermo-plastic PI exhibits a remarkably larger increase in core loss when including the reduced iron powder. By contrast, the sample including the thermoset PI exhibits a lower level in the atomized iron powder alone and hardly exhibits an increase even when the reduced iron powder is increased. Namely, the thermoset PI hardly increases the core loss even when it is combined with the sample including the reduced iron powder. With respect to the workability in the cutting process, the sample including the reduced iron powder excels.

Upon summarizing the above experiment results from mixing the reduced iron powder to the atomized iron powder, the following is confirmed:

(1) When the reduced iron powder is included, a property of compression is worse than that of the sample including the atomized iron powder alone. The density is thereby decreased, resulting in a low magnetic flux density.

(2) When the reduced iron powder is included, the radial crushing strength is increased.

(3) When the reduced iron powder is included, the sample including the thermoset PI exhibits a lower core loss than that including the thermoplastic PI.

(4) When the reduced iron powder is included, the workability in cutting process is remarkably improved.

From the above (1) to (4), the sample additionally including the reduced iron powder has a lower density and a lower magnetic flux density than that including the atomized iron powder alone. However, when the thermoset PI is included, the core loss is decreased and the workability in the cutting process is improved. This sample is thereby proper to an iron core, being properly used as a stator core 32.

Next, mixture amounts of the atomized iron powder and reduced iron powder, and an addition amount of the thermoset PI will be explained below.

Properties of compressed powder cores containing different reduced iron powder content ratios and different thermoset PI content ratios are shown in FIGS. 16 to 19.

Figure 16:
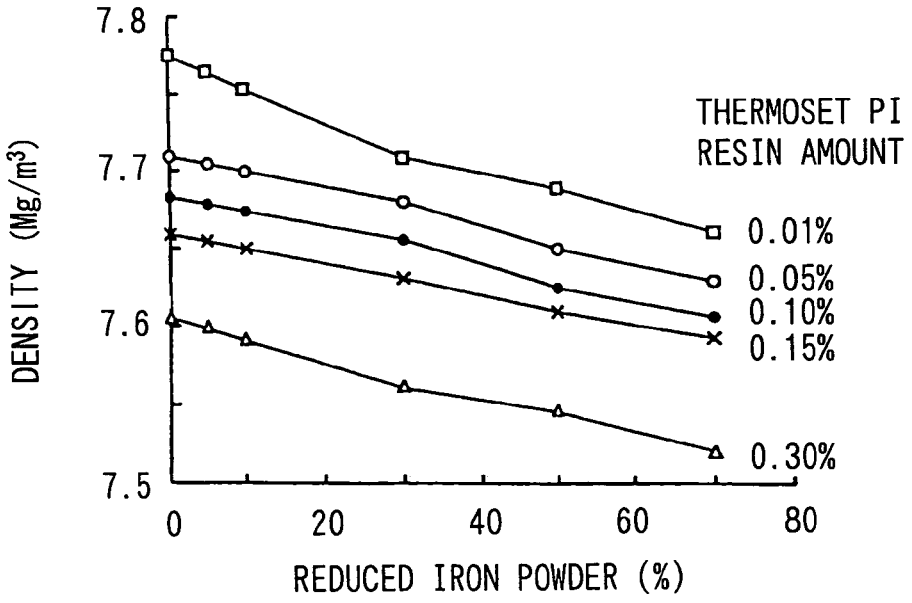
FIG. 16 is a graph showing a relationship of a reduced iron content ratio with a density when thermoset PI is changed in its content ratio.

As shown in FIG. 16, a density decreases with increasing reduced iron powder content ratio or with increasing thermoset PI content ratio.

Figure 17:
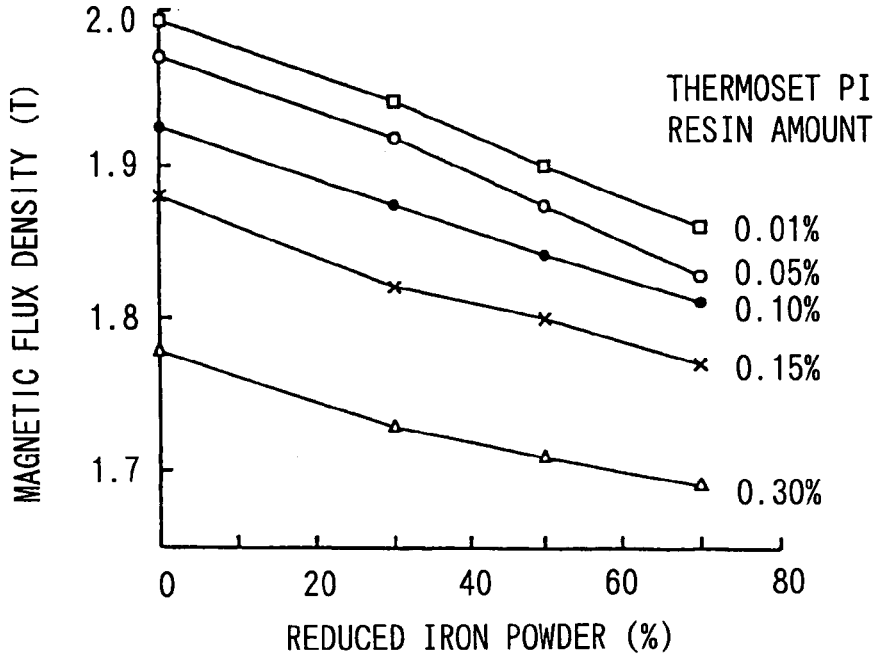
FIG. 17 is a graph showing a relationship of a reduced iron content ratio with a magnetic flux density when thermoset PI is changed in its content ratio.

As shown in FIG. 17, a magnetic flux density decreases with increasing reduced iron powder content ratio or with increasing thermoset PI content ratio.

Figure 18:
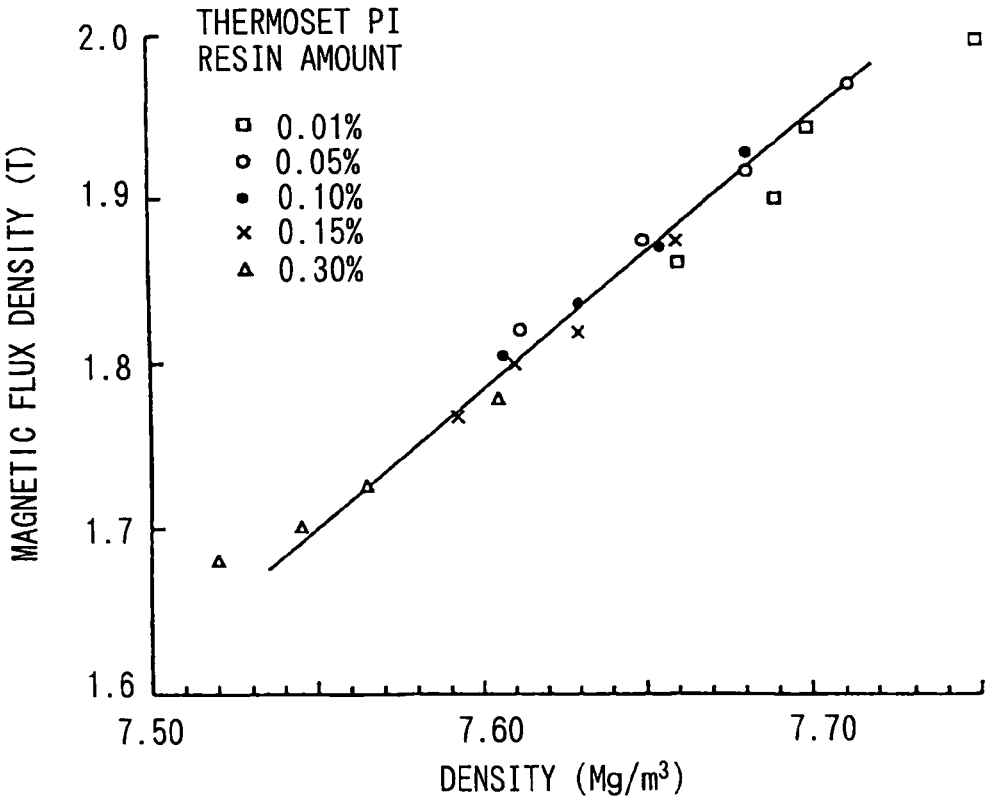
FIG. 18 is a graph showing a relationship of a density with a magnetic flux density.

FIG. 18 shows a relationship between a density and magnetic flux density. Regardless of the resin content ratio and reduced iron powder amount, the density and magnetic flux density have a correlation with each other. This graph approximately indicates that $B=1.7d-11.14$, where "B" is magnetic flux density, and "d" is density.

Figure 19:
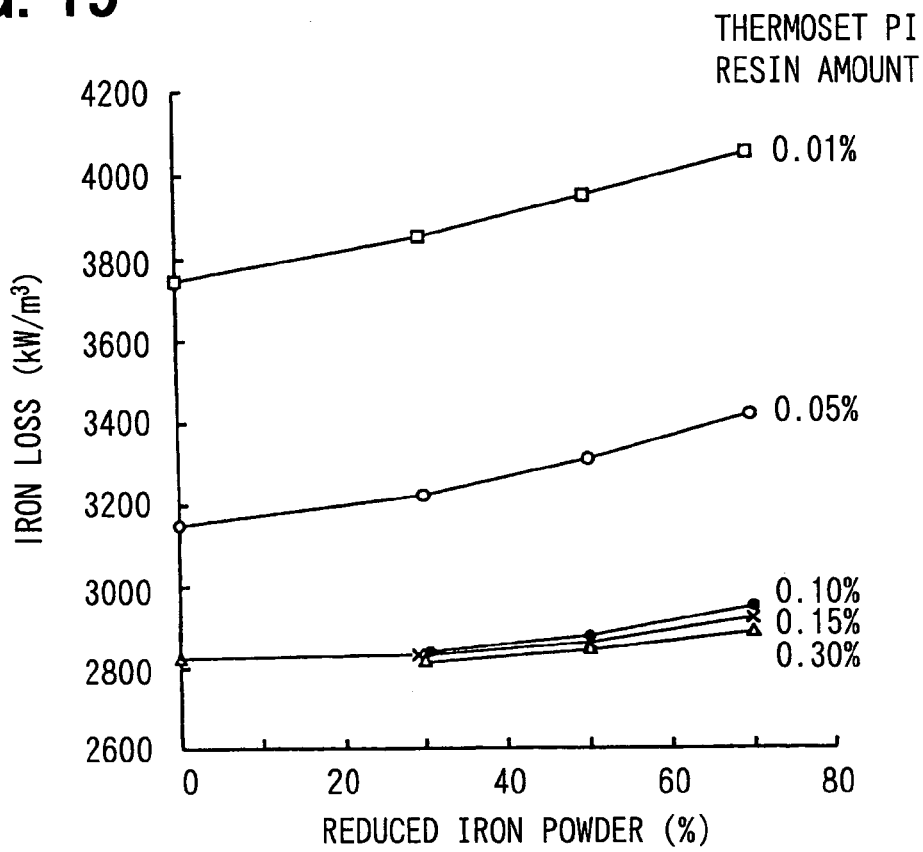
FIG. 19 is a graph showing a relationship of a reduced iron content ratio with a core loss (iron loss) when thermoset PI is changed in its content ratio.

Further, as shown in FIG. 19, a core loss increases with increasing reduced iron powder amount. Within a range of the thermoset PI content ratio of 0.10 to 0.30 weight %, the similar properties are indicated; by contrast, not more than 0.05%, the core loss increases.

With respect to a cutting surface, regardless of the resin content ratio, the sample including the reduced iron powder content ratio of 5 weight % exhibits a recognized effect. As the reduced iron powder increases, the cutting surface becomes better.

The summary of the above experiments shows as follows:

(1) A magnetic flux density becomes not less than 1.8 T when a thermoset PI content ratio is not more than 0.15 weight % and a reduced iron powder content ratio is not more than 50 weight %. The magnetic flux density of 1.8 T is regarded as a high level in comparison to 1.7 T that is obtained from a compressed powder core where atomized iron powder is used as iron powder and PPS of 0.3 weight % is included as a resin.

(2) When a target of a magnetic flux density is set to "not less than 1.75 T" that is higher than that of the comparative compressed powder core, the target is achieved when the thermoset PI content ratio is not more than 0.15 weight % and the reduced iron content ratio is not more than 70 weight %.

(3) When a target of a core loss is set to "not more than 3000 $kW/m^3$," the target is achieved when the thermoset PI content ratio is not less than 0.10 weight % and the reduced iron content ratio is not more than 70 weight %.

(4) When a limit is not set to a core loss property, a magnetic flux density increases with decreasing resin content ratio.

(5) A surface state of a compressed powder core after the cutting process is improved in surface coarseness and fracture by including reduced iron powder. To recognize that a cutting surface is improved, a reduced iron powder amount of not less than 5 weight % is required. Further, the cutting surface becomes better as the reduced iron powder content ratio increases.

From the above, a preferred embodiment is obtained from a reduced iron powder content ratio from 5 to 50 weight % both inclusive and a thermoset PI content ratio from 0.10 to 0.15 weight % both inclusive. Here, the preferred embodiment includes improved workability in a cutting process, a magnetic flux density of not less than 1.8 T, and a core loss of not more than 3000 $kW/m^3$. Further, when a magnetic flux density of not less than 1.75 T is required and relatively high core loss is allowed, this requirement is obtained from a reduced iron powder content ratio from 5 to 70 weight % both inclusive and a thermoset PI content ratio of not more than 0.15 weight %. Further, when a higher magnetic flux density is required and a relatively high core loss is allowed, this requirement can be obtained by setting the minimum level of a thermoset PI content ratio to 0.01 weight %. However, it is favorable that a magnetic flux density is as high as possible and a core loss is as low as possible, so that a reduced iron powder content ratio should not exceed 50 weight %, as described above.

Next, enhancing a property of compression of powder due to addition of PTFE (polytetrafluoro-ethylene) will be explained below. As explained above, workability in a cutting process is improved by increasing iron powder; however, a property of compression is worsened in comparison with that using atomized iron powder. To increase the magnetic flux density, lubricating powder is added. PTFE is studied as the lubricating powder.

Figure 20:
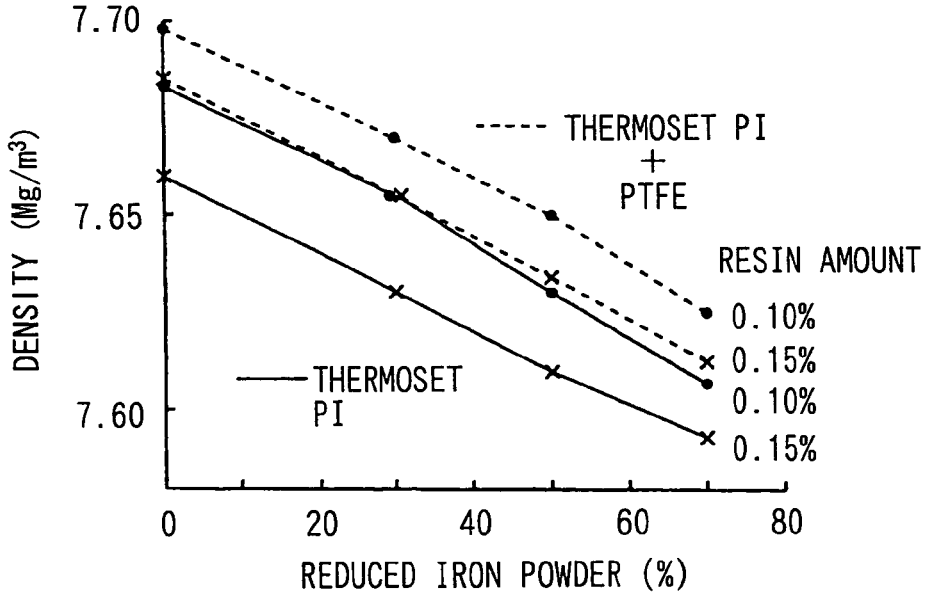
FIG. 20 is a graph showing comparison in a relationship of a reduced iron content ratio with a density when PTFE is added or not added.
Figure 21:
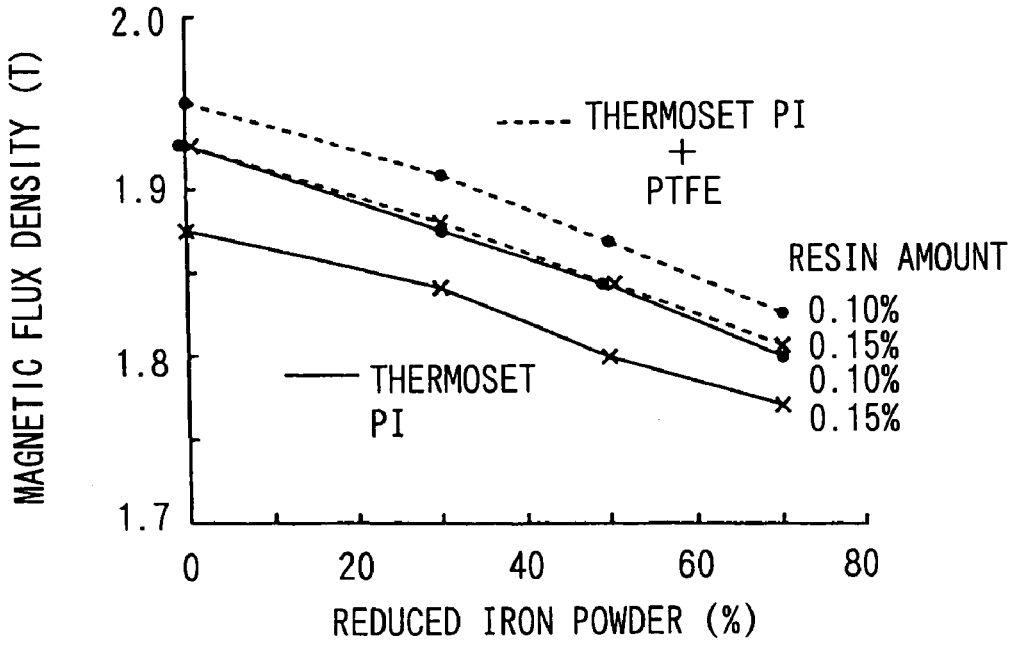
FIG. 21 is a graph showing comparison in a relationship of a reduced iron content ratio with a magnetic flux density when PTFE is added or not added.
Figure 22:
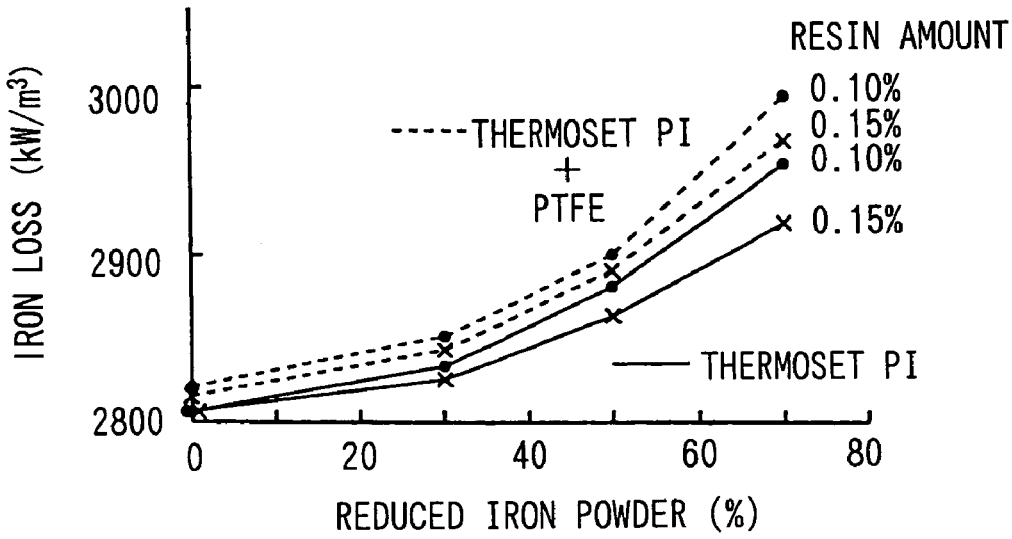
FIG. 22 is a graph showing comparison in a relationship of a reduced iron content ratio with a core loss (iron loss) when PTFE is added or not added.

Properties of samples of compressed powder cores are shown in FIGS. 20 to 22 with the following conditions: a resin content ratio is varied between 0.10 weight % and 0.15 weight %; a mixture ratio of the atomized iron powder and reduced iron powder is varied; and a resin is varied between the thermoset PI and a mixture of a weight ratio of 1:1 of the thermoset PI and the PTFE. These samples of the compressed powder cores are formed similarly with the above experiments and a heating treatment is the same as that for the thermoset PI.

As showing FIG. 20 showing a density, the samples including the thermoset PI and PTFE have higher densities by approximately 0.02 $Mg/m^3$ than those including the thermoset PI alone.

As showing FIG. 21 showing a magnetic flux density, the samples including the mixture of the thermoset PI and PTFE exhibit higher magnetic flux densities with increasing densities. The magnetic flux density exceeds 1.8 T even when the reduced iron powder content ratio is 70 weight % and the content ratio of the mixture of the thermoset PI and PTFE is 0.10 weight %.

As shown in FIG. 22, a core loss of the sample using the mixture of the thermoset PI and PTFE is slightly higher than that using the thermoset PI alone. A core loss is not more than 3000 $kW/m^3$ even when the reduced iron content ratio is 70 weight %, the content ratio of the mixture of the thermoset PI and PTFE is 0.10 weight %.

The summary of the above experiments is as follows:

(1) By replacing a part of the added thermoset PI with the PTFE, the property of compression of powder is enhanced, which obtains a higher density to thereby obtain a compressed powder core having a higher magnetic flux density. As a result, the reduced iron powder content ratio can be increased. Further, by containing the PTFE, abrasion between the iron powder and metal mold is decreased while the compressed powder body undergoes the compression formation, so that an effect extending life of the metal mold can be obtained.

(2) The PTFE slightly increases a core loss; however, the core loss is kept not more than 3000 kW/m3 with the PTFE content ratio of 0.10 weight % even when the reducing iron powder content ratio is 70 weight %.

From the above, a compressed powder core having a higher magnetic flux density and a core loss that is suppressed can be obtained even when the resin content ratio and reduced iron powder are contained in a large amount, e.g., the resin content ratio of 0.15 weight %, and the reduced iron powder content of 70 weight %. This compressed powder core includes the PTFE as a partial substitution of the thermoset PI, of which content ratio of 0.01 to 0.15 weight %, favorably 0.1 to 0.15 weight %, and still exhibits a higher density and a higher magnetic flux density. This compressed powder core is properly applied to a stator core 32 mounted in a fuel injection valve 1.

Next, a manufacturing method of a stator core 32 containing PTFE will be explained below. In the above experiments, the weight ratio of the thermoset PI and PTFE is 1:1; however, it can be varied to, e.g., 3:1, or 1:3, as needed, to achieve a satisfied core loss according to the reduced iron powder content ratio. Here, the PTFE causes a core loss to increase than the thermoset PI does, so that the PTFE is preferred to be not more than three-fourths of the resin content ratio. Thus, in the manufacturing method in the case where the PTFE is contained, at first, a powder mixture of the iron powder and resin power that constitutes the stator core 32 undergoes a compression formation using a metal mold. To this metal mold, a lubricating agent is applied to form a compressed powder body (stator core compression formation).

Next, when the PTFE is contained in the resin powder, the compressed powder body is heated at 150 to 250° C., favorably at 200° C. The compressed powder body is thereby firmly solidified. The thermoset PI changes in quality at a high temperature at which the PTFE softens or melts, so that an insulating property is degraded and the core loss is increased. Therefore, the temperature for heating is favorably within a range from 150 to 250° C. (Solidifying process). Finally, a cutting process or grinding process is applied to a suction surface and the like to thereby finish the stator core 32 (Finishing process).

Through the above processes, the stator core 32 of the electromagnetic valve 5 is manufactured. This stator core 32 obtains a higher order of balance between the capability and cost by adopting the technology explained in the example 1, which can provide an excellent fuel injection valve 1. Here, in this example 2, the thermoset PI alone, or the mixture of the thermoset PI and PTFE is explained as an example of the resin powder of the SMC constituting the stator core 32; however, the PTFE alone can be adopted.

In the above examples, the direct current magnetism property of the stator core 32 is matched with that of the armature 24 by controlling the resin content ratio or resin particle diameter of the SMC constituting the stator core 32. However, when the moving core 34 in the armature 24 mainly affects the magnetism property, the direct current magnetism property of the moving core 34 can be matched with that of the armature 24.

Further, the direct current magnetism property of the stator core 32 is matched with that of the armature 24 (or the moving core 34) by controlling the resin content ratio or resin particle diameter of the SMC constituting the stator core 32. By contrast, the direct current magnetism property of the armature 24 (or the moving core 34) can be matched with that of the stator core 32. Here, for example, the direct current magnetism property of the armature 24 (or the moving core 34) can be matched with that of the stator core 32 by constituting the moving core 34 using the SMC and controlling the resin content ratio and resin particle diameter etc.

In the above examples, the moving core 34 adopts iron powder formed of sintered metal which is silicon steel. However, iron powder can include iron of a soft magnetic material such as pure iron, soft iron, a mixture of multiple kinds of iron etc. As an example of the silicon steel, silicon steel containing 1 to 3 weight % silicon is used; however, the silicon steel can also include different one from the silicon steel containing 1 to 3 weight % silicon, or a mixture of the silicon steel containing 1 to 3 weight % silicon and the different silicon steel from the silicon steel containing 1 to 3 weight % silicon.

In the above examples, the moving core 34 adopts iron powder formed of sintered metal; however, the moving core 34 can be formed of a soft magnetic material that is formed of a known metal material (e.g., pure metal). Here, the soft magnetic material can include silicon steel or a soft magnetic material such as pure iron, and soft iron.

In the above examples, the moving core 34 and shaft 35 are connected by sintering; however, other technologies can be adopted such as caulking, press fitting, and welding.

In the above examples, the moving core 34 and shaft 35 are prepared to be separately at first and then integrated; however, the moving core 34 and shaft 35 can be prepared as a single component.

In the above examples, the present invention is directed to an electromagnetic valve 5 of a fuel injection valve 1; however, it can be directed to other valves mounted in a vehicle such as an EGR valve, or oil path switching valve. It can be also directed to a linear solenoid etc. other than the electromagnetic valves.

It will be obvious to those skilled in the art that various changes may be made in the above-described embodiments of the present invention. However, the scope of the present invention should be determined by the following claims.

What is claimed is:

1. An electromagnetic actuator comprising:

an armature that includes a moving core having a magnetism property and that is axially movably supported; and a solenoid that includes a coil that generates magnetomotive force due to conduction of electric current and that includes a stator core that sucks the moving core by magnetomotive force generated by the coil, wherein the stator core is formed of a composite magnetic material formed by solidifying iron powder and resin powder comprising a thermo-plastic resin; and wherein a B-H curve of the stator core and a B-H curve of the moving core are approximately equivalent to each other.

2. The electromagnetic actuator of claim 1, wherein, when the a B-H curve of the moving core is defined as 100%, a B-H curve of the stator core falls within a range from 80% to 120% both inclusive.

3. The electromagnetic actuator of claim 1, wherein the resin powder in the composite magnetic material forming the stator core is contained from 0.005 weight % to 0.1 weight % both inclusive and has particle diameters that fall within a range from 0.005 μm to 25 μm both inclusive.

4. The electromagnetic actuator of claim 1, wherein the resin powder in the composite magnetic material forming the stator core is contained from 0.005 weight % to 0.1 weight % both inclusive and has particle diameters that fall within a range from 5 μm to 50 μm both inclusive.

5. The electromagnetic actuator of claim 1, wherein the resin powder in the composite magnetic material forming the stator core is contained from 0.005 weight % to 0.1 weight % both inclusive and has particle diameters that fall within a range from 5 μm to 25 μm both inclusive.

6. The electromagnetic actuator of claim 1, wherein the resin powder in the composite magnetic material forming the stator core includes any one of six, wherein:

a first is polyphenylene-sulfide;

a second is thermo-plastic polyimide;

a third is a mixture of polyphenylene-sulfide and thermo-plastic polyimide;

a fourth is a mixture of polyphenylene-sulfide and a resin that has a higher glass transition temperature than the polyphenylene-sulfide;

a fifth is a mixture of thermo-plastic polyimide and a resin that has a higher glass transition temperature than the thermo-plastic polyimide; and a sixth is a mixture of polyphenylene-sulfide, thermo-plastic polyimide, and a resin that has a higher glass transition temperature than the polyphenylene-sulfide.

7. The electromagnetic actuator of claim 6, wherein the resin that has the higher glass transition temperature than the thermo-plastic polyimide is any one of non-thermo-plastic polyimide, polyamide-imide, and polyamino-bismale-imide.

8. The electromagnetic actuator of claim 6, wherein the resin that has the higher glass transition temperature than the polyphenylene-sulfide is any one of polyphenylene-oxide, polysulfone, polyether-sulfone, polyarylate, polyether-imide, non-thermo-plastic polyimide, polyamide-imide, and polyamino-bismale-imide.

9. The electromagnetic actuator of claim 6, wherein the resin that has the higher glass transition temperature than the polyphenylene-sulfide or the thermo-plastic polyimide is contained equal to or less than half of the polyphenylene-sulfide or the thermo-plastic polyimide, respectively.

10. The electromagnetic actuator of claim 1, wherein the resin powder in the composite magnetic material forming the stator core is:

polytetrafluoro-ethylene or a mixture of thermoset polyimide and polytetrafluoro-ethylene.

11. The electromagnetic actuator of claim 1, wherein the iron powder in the composite magnetic material forming the stator core is formed of one of atomized iron, reduced iron, and a mixture of atomized iron and reduced iron.

12. The electromagnetic actuator of claim 1, wherein the armature further includes:

a shaft that is axially slidably supported and to which the moving core is fastened, wherein the moving core is formed of a soft magnetic material, and wherein the soft magnetic material is formed of the composite magnetic material forming the stator core.

13. The electromagnetic actuator of claim 1, wherein the armature further includes:

a shaft that is axially slidably supported and to which the moving core is fastened, wherein the moving core is formed of a soft magnetic material, and wherein the soft magnetic material is formed of silicon steel where silicon is contained within an iron.

14. The electromagnetic actuator of claim 13, wherein the soft magnetic material forming the moving core is silicon steel where a silicon content ratio is from 1 weight % to 3 weight % both inclusive.

15. The electromagnetic actuator of claim 13, wherein the soft magnetic material forming the moving core is formed of sintered metal that is formed by a method of powder metallurgy.

16. The electromagnetic actuator of claim 15, wherein the moving core of the soft magnetic material is integrated with the shaft by sintering connection.

17. The electromagnetic actuator of claim 16, wherein the shaft is a steel material whose hardness is recovered by applying a thermal treatment after undergoing heat in the sintering connection.

18. The electromagnetic actuator of claim 16, wherein the shaft is any one of high-speed tool steel, alloy tool steel, martensitic stainless steel, and bearing steel.

19. The electromagnetic actuator of claim 13, wherein the shaft is a steel material formed of a ferromagnetic material.

* * * * *